US011085175B2

(12) United States Patent
Fourman et al.

(10) Patent No.: US 11,085,175 B2
(45) Date of Patent: Aug. 10, 2021

(54) PULLDOWN KITCHEN FAUCET WITH SPRING SPOUT

(71) Applicant: Delta Faucet Company, Indianapolis, IN (US)

(72) Inventors: Terrence Lee Fourman, Carmel, IN (US); Jeffrey Lee Moore, Frankfort, IN (US); Kyle Robert Davidson, Noblesville, IN (US); Randy L. Schneider, II, Carmel, IN (US); Joel D. Sawaski, Indianapolis, IN (US); Alfred Charles Nelson, Westfield, IN (US)

(73) Assignee: Delta Faucet Company, Indianapolis, IN (US)

( * ) Notice: Subject to any disclaimer, the term of this patent is extended or adjusted under 35 U.S.C. 154(b) by 817 days.

(21) Appl. No.: 14/996,974

(22) Filed: Jan. 15, 2016

(65) Prior Publication Data

US 2016/0215482 A1 Jul. 28, 2016

Related U.S. Application Data

(60) Provisional application No. 62/107,730, filed on Jan. 26, 2015.

(51) Int. Cl.
*E03C 1/04* (2006.01)
*E03C 1/05* (2006.01)

(52) U.S. Cl.
CPC ..... *E03C 1/0404* (2013.01); *E03C 1/057* (2013.01); *E03C 2001/0415* (2013.01); *Y10T 137/9464* (2015.04)

(58) Field of Classification Search
CPC ..... E03C 1/057; E03C 1/0404; E03C 2001/0415; Y10T 137/9464
See application file for complete search history.

(56) References Cited

U.S. PATENT DOCUMENTS

| | | | |
|---|---|---|---|
| 4,431,031 | A | 2/1984 | Ettlinger |
| 4,709,715 | A | 12/1987 | Knight |
| 5,624,074 | A | 4/1997 | Parisi |
| 5,758,690 | A | 6/1998 | Humpert et al. |

(Continued)

FOREIGN PATENT DOCUMENTS

| | | |
|---|---|---|
| CN | 200940723 Y | 8/2007 |
| CN | 201090833 | 7/2008 |

(Continued)

OTHER PUBLICATIONS

Cinaton Faucet, K2004CP-PVD Kitchen Sink Faucet With Spring Pull-Down Spout, Oct. 17, 2014, retrieved from: http://www.cinaton.com/cinaton/spec.php?id=8.

(Continued)

*Primary Examiner* — Atif H Chaudry
(74) *Attorney, Agent, or Firm* — Bose McKinney & Evans LLP

(57) ABSTRACT

A faucet including a spring spout supporting a spout nest, and a sprayhead releasably coupled to the spout nest. A docking cradle is supported by the spout base and is configured to releasably couple to the spout nest. The faucet may include a capacitive sensor operably coupled to the spring spout by at least one capacitive coupling.

23 Claims, 17 Drawing Sheets

(56) References Cited

U.S. PATENT DOCUMENTS

| | | | | |
|---|---|---|---|---|
| 6,820,291 | B1 * | 11/2004 | Weaver | F16L 19/0218 239/588 |
| 6,915,816 | B2 | 7/2005 | Nelson et al. | |
| 6,938,837 | B2 | 9/2005 | Nelson et al. | |
| 7,162,782 | B1 | 1/2007 | Nelson | |
| 7,690,395 | B2 | 4/2010 | Jonte et al. | |
| 7,753,079 | B2 | 7/2010 | Nelson | |
| 8,061,386 | B2 | 11/2011 | Mueller et al. | |
| 8,070,076 | B2 | 12/2011 | Erickson et al. | |
| 8,407,828 | B2 | 4/2013 | Vogel et al. | |
| 8,424,569 | B2 | 4/2013 | Marty et al. | |
| 8,621,681 | B2 | 1/2014 | Macan et al. | |
| 8,713,725 | B2 | 5/2014 | Alder et al. | |
| 8,800,075 | B2 | 8/2014 | Van Leyen et al. | |
| 8,869,821 | B2 | 10/2014 | Laera | |
| D733,259 | S | 6/2015 | Flowers et al. | |
| 2007/0157978 | A1 | 7/2007 | Jonte et al. | |
| 2008/0196160 | A1 | 8/2008 | Alder et al. | |
| 2010/0170588 | A1 | 7/2010 | Nelson | |
| 2012/0042973 | A1 * | 2/2012 | Ko | E03C 1/0404 137/801 |
| 2013/0019974 | A1 * | 1/2013 | Laera | E03C 1/0404 137/801 |
| 2013/0276911 | A1 * | 10/2013 | Meehan | E03C 1/04 137/355.16 |
| 2014/0015246 | A1 | 1/2014 | Erickson et al. | |
| 2014/0026980 | A1 | 1/2014 | Esche et al. | |
| 2014/0069520 | A1 | 3/2014 | Esche et al. | |
| 2014/0116553 | A1 | 5/2014 | Schoolcraft et al. | |
| 2014/0251451 | A1 | 9/2014 | Yang et al. | |
| 2014/0261750 | A1 * | 9/2014 | Rosko | F16K 21/00 137/78.1 |
| 2015/0013064 | A1 * | 1/2015 | Marty | E03C 1/057 4/668 |
| 2015/0013812 | A1 | 1/2015 | Bosio | |
| 2015/0158047 | A1 | 6/2015 | Johnson et al. | |
| 2015/0308088 | A1 | 10/2015 | Enlow et al. | |

FOREIGN PATENT DOCUMENTS

| | | |
|---|---|---|
| CN | 101563561 | 10/2009 |
| CN | 202674448 | 1/2013 |
| CN | 202674448 U * | 1/2013 |
| WO | WO 2008/090299 | 7/2008 |

OTHER PUBLICATIONS

Jewel Faucet, 25657 Single Hole Kitchen Faucet with Spring Spout and Magnetic Commercial Sprayer, Oct. 17, 2014, retrieved from: http://www.amazon.com/Jewel-Faucets-25657-Magnetic-Commercial/dp/B00AIHJQQO.

Blanco Faucet, MeridianSingle-Handle Pull-Down Sprayer Kitchen Faucet, Oct. 17, 2014, retrieves from: http://www.homedepot.com/p/Blanco-Meridian-Single-Handle-Pull-Down-Sprayer-Kitchen-Faucet-in-Poished-Chrome-440558/202373712?MERCH=REC-_-PIPHorizontall-4-_-Na-_-202373712-_-N.

Ouku Faucet, Sink Faucet with Pull Out Spray Pull Down Sprayer, Oct. 17, 2014, retrieved from: http://www.amazon.com/Kitchen-Discount-Designer-Plumbing-Fixtures/dp/B00411UXG8.

Lannister Faucet, Lannister Pull-Down Kitchen Faucet with Spring Spout, Oct. 17, 2014, retrieved from: http://www.signaturehardware.com/kitchen/kitchen-faucets/lannister-high-rise-kitchen-faucet-with-swivel-spout-and-spring-pull-down-sprayer.html.

Kingston Faucet, Kingston Brass Single-Handle Kitchen Faucet with Pull-Down Spring Spout, Oct. 17, 2014, retrieved from: http://www.homedepot.com/p/Unbranded-Kingston-Brass-Single-Handle-Kitchen-Faucet-with-Pull-Down-Spring-Spout-in-Oil-Rubbed-Bronze-HGS8875CTL/204158236.

Vines Faucet, Contemporary Kitchen Sink Faucet Single Handle Pull Down Pre-Rinse Spring with Swivel Spouts, Oct. 17, 2014, retrieved from: http://www.amazon.com/Contemporary-Kitchen-Faucet-Single-Pre-Rinse/dp/B00K67HM94.

Ultra Faucet, Ultra UF 12205 Single Handle Oil Rubbed Bronze Kitchen Faucet with Pull-Down Spout, Oct. 17, 2014, retrieved from: http://www.wholesaleplumbing.com/ultra-faucet-uf12205.html#.VEFSs_ldWdl.

Water Creation Faucet, F5-0004-01 Pre-Rinse Kitchen Faucet With Dual Function Pull Down Spring Spray and Deck Plate, Oct. 17, 2014, retrieved from: http://www.wayfair.com/Water-Creation-Water-Creation-F5-0004-01-Pre-Rinse-Kitchen-Faucet-With-Dual-Function-Pull-Down-Spring-Spray-And-Deck-Plate-F5-0004-01-YWC1017.html.

Aquabrass, Installation Guide, Zest 3845N, Pull-out dual stream made kitchen faucet, last revision Jul. 24, 2014, pp. 1-8.

Ariza, Ariza Kitchen Faucet with Spring Spout, retrieved on Jul. 21, 2015 from http:www.signaturehardware.com/ariza-kitchen-faucet-with-spring-spout.html.

Kingston Brass, Single-Handle Spring Spout Pull-Down Sprayer Kitchen Faucet in Satin Nickel, retrieved on Jul. 21, 2015 from http://www.homedepot.com/p/Kingston-Brass-Single-Handle-Spring-Spout-Pull-Down-Sprayer-Kitchen-Faucet-in-Satin-Nickel-HGS8888DL/203856672#product_description.

Watersone, The Wheel Pull Down Kitchen Faucet, retrieved on Jul. 21, 2015 from http://www.waterstoneco.com/faucets/whell-pulldown-kitchen-faucet.php.

KWC ONO, KWC Faucets, provided at least as early as Jan. 24, 2015.

* cited by examiner

PULLDOWN KITCHEN FAUCET WITH SPRING SPOUT

CROSS-REFERENCE TO RELATED APPLICATION

This application claims priority to Provisional Patent Application Ser. No. 62/107,730, filed Jan. 26, 2015, the disclosure of which is expressly incorporated herein by reference.

BACKGROUND AND SUMMARY OF THE DISCLOSURE

The present invention relates generally to kitchen faucets and, more particularly, to a pulldown kitchen faucet including a spring spout.

Pulldown kitchen faucets are well known in the art. Such kitchen faucets typically include a delivery spout including a passageway for slidably supporting a flexible tube fluidly coupled to a sprayhead. The sprayhead may be removably coupled or docked to an end of the delivery spout. In operation, the sprayhead may be removed from an end of the delivery spout and manipulated to dispense water at desired locations within a sink basin.

The present invention provides a pulldown kitchen faucet with the added functionality of a pre-rinse industrial spring spout. More particularly, the faucet provides the functionality of a pre-rinse spring faucet (e.g., vertical and horizontal motion) combined with the added flexibility (e.g., reach) of a pulldown kitchen sprayer.

According to an illustrative embodiment of the present disclosure, a faucet includes a spout base, a spring spout including a helical spring having opposing first and second ends, the first end coupled to the spout base. A flexible tube is supported for sliding movement within the spout base and the spring spout. A spout nest is coupled to the second end of the spring spout. A sprayhead is fluidly coupled to the flexible tube and is releasably coupled to the spout nest. A docking cradle is supported by the spout base and is configured to releasably couple to the spout nest.

According to a further illustrative embodiment of the present disclosure, a faucet includes a spring spout, a flexible tube supported for the sliding movement within the spring spout, and a spout nest coupled to the spring spout. A sprayhead is fluidly coupled to the flexible tube and is releasably coupled to the spout nest. A docking cradle is configured to releasably couple to the spout nest. A first mode of operation is defined when the spout nest is coupled to the docking cradle, and the sprayhead is coupled to the spout nest. A second mode of operation is defined when the spout nest is removed from the docking cradle, and sprayhead is coupled to the spout nest. A third mode of operation is defined when the spout nest is coupled to the docking cradle, and the sprayhead is removed from the spout nest. A fourth mode of operation is defined when the spout nest is removed from the docking cradle, and the sprayhead is removed from the spout nest.

According to another illustrative embodiment of the present disclosure, a method of operating a kitchen faucet includes the step of providing a spring spout, a spout nest coupled to an end of the spring spout, a sprayhead releasably coupled to the spout nest, and a docking cradle configured to releasably couple to spout nest. The method further includes the steps of coupling the spout nest to the docking cradle, and coupling the sprayhead to the spout nest. The method also includes the steps of removing the spout nest from the docking cradle, and removing the sprayhead from the spout nest.

According to a further illustrative embodiment of the present disclosure, a faucet includes a spout lower hub, a spout upper tube supported by the spout lower hub, a lower pivot coupling between the spout lower hub and the spout upper tube, the lower pivot coupling providing for rotation between the spout upper tube and the spout lower hub, and a lower capacitive coupling between the spout lower hub and the spout upper tube. An upper delivery spout is supported by the spout upper tube, an upper pivot coupling extends between the upper support tube and the upper delivery spout, the upper pivot coupling providing for rotation between the upper delivery spout and the spout upper tube, and an upper capacitive coupling between the upper support tube and the upper delivery spout. A capacitive sensor is operably coupled with the upper delivery spout through the lower capacitive coupling and the upper capacitive coupling.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
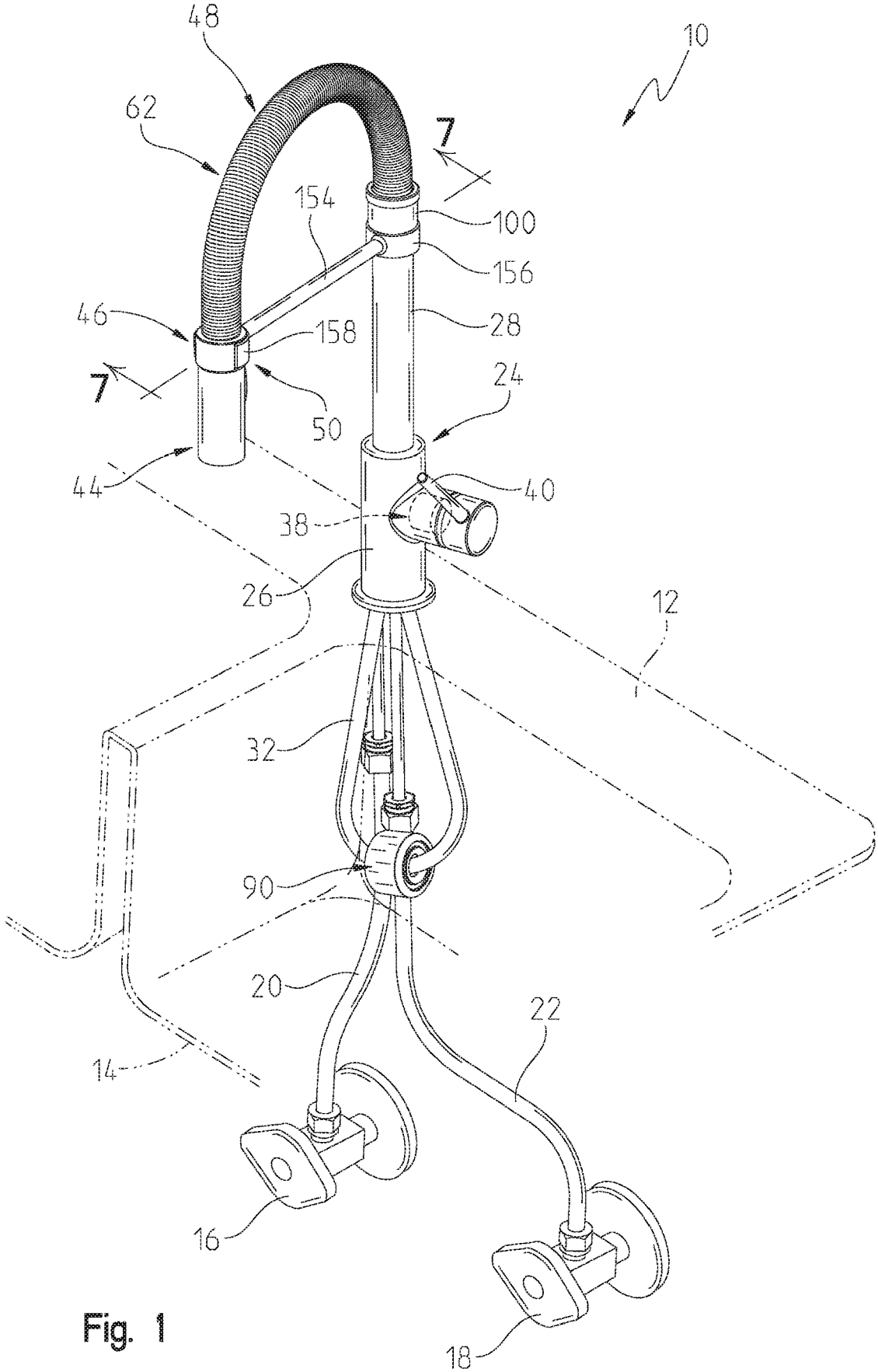
FIG. 1 is a perspective view of an illustrative kitchen faucet of the present disclosure mounted on a sink deck and fluidly coupled to hot and cold water supplies.

The embodiments of the invention described herein are not intended to be exhaustive or to limit the invention to precise forms disclosed. Rather, the embodiments selected for description have been chosen to enable one skilled in the art to practice the invention.

Referring initially to FIGS. 1-4, an illustrative kitchen faucet 10 is shown mounted to a deck 12 of a sink basin 14 and fluidly coupled to hot water and cold water supplies, illustratively conventional hot and cold water stops 16 and 18, through flexible hot and cold water risers or supply tubes 20 and 22, respectively. More particularly, the kitchen faucet 10 illustratively includes a spout base 24 mounted to the sink deck 12.

Figure 5:
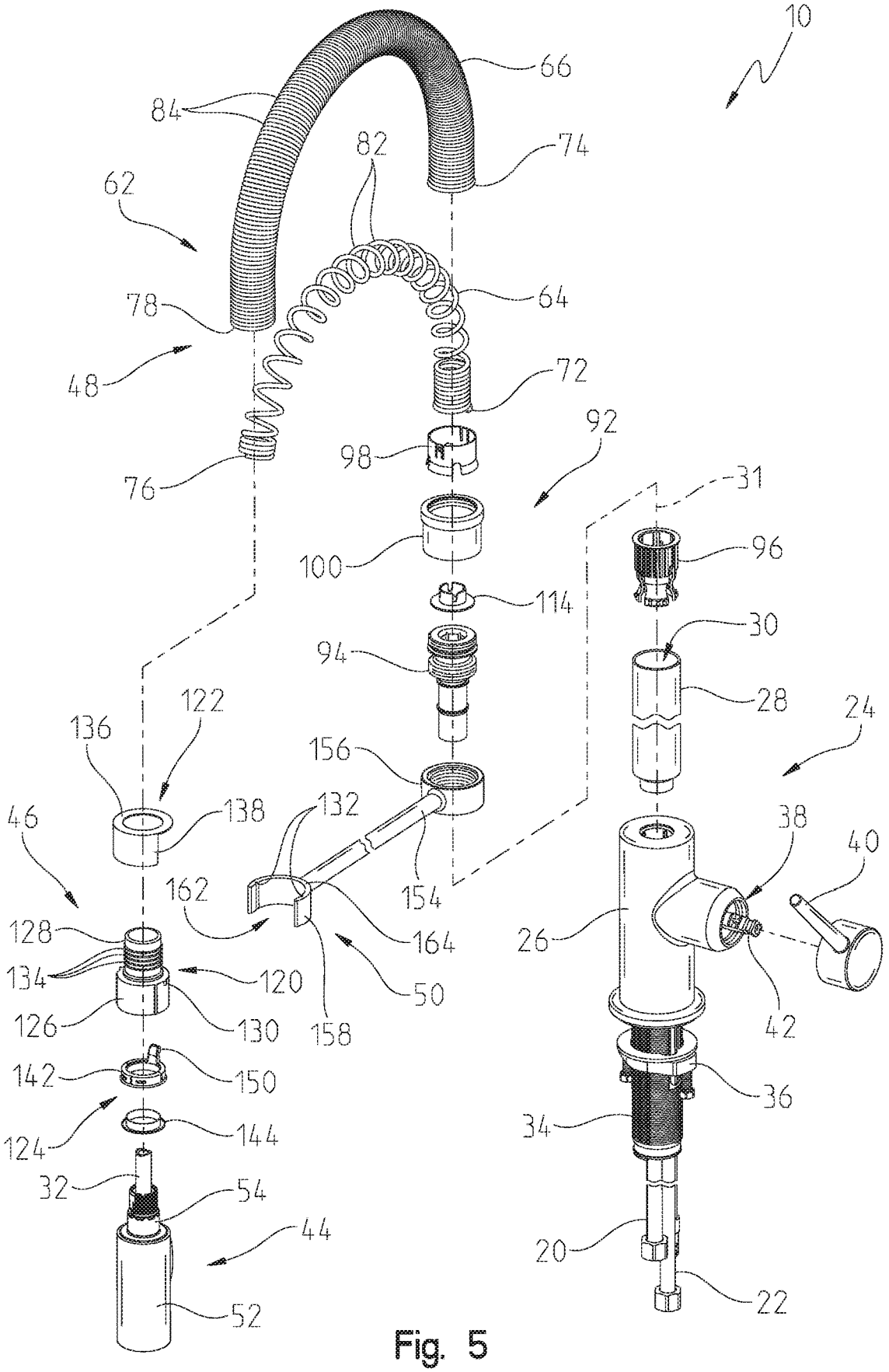
FIG. 5 is an exploded perspective view of the kitchen faucet of FIG. 1.
Figure 6:
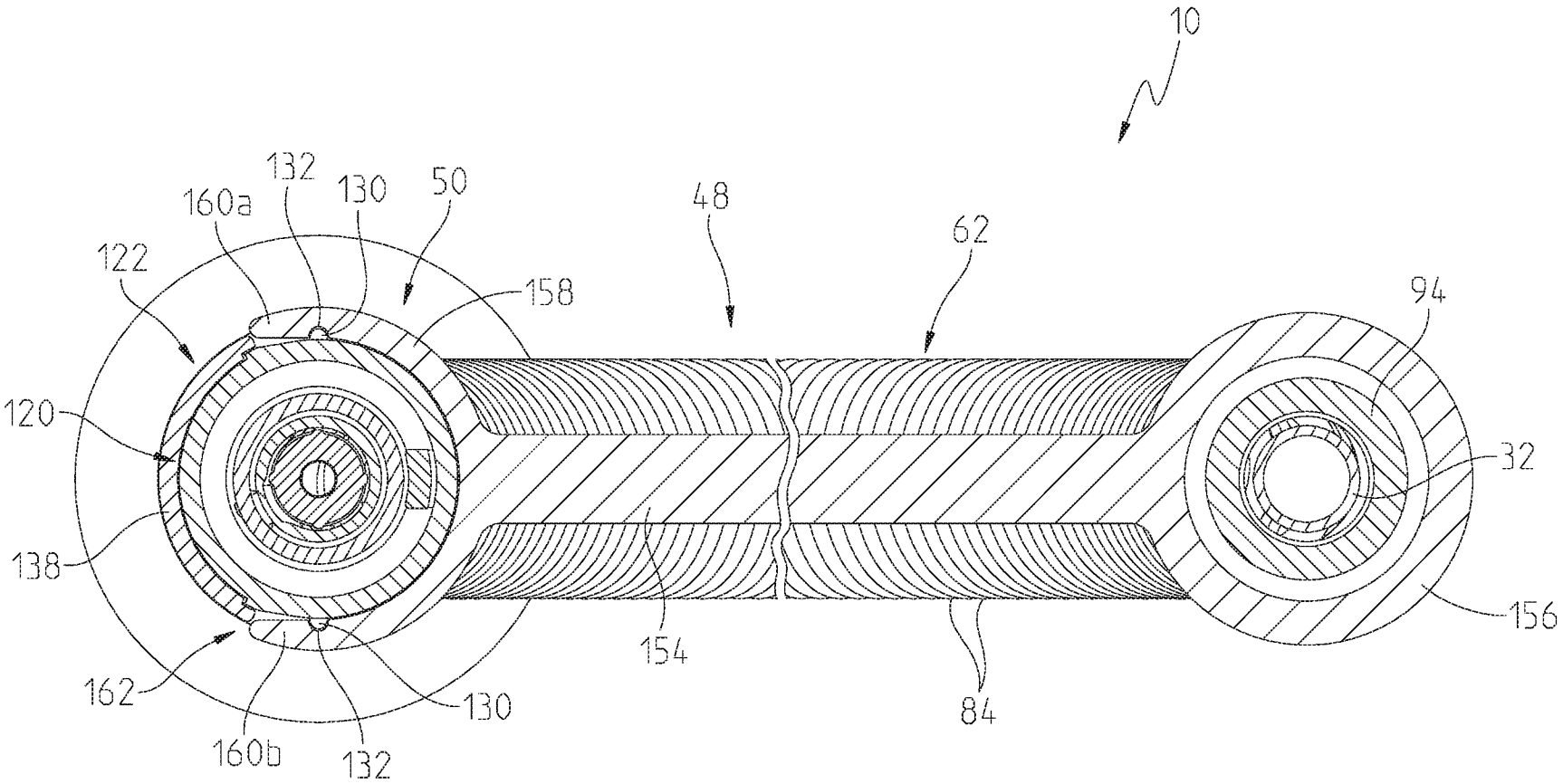
FIG. 6 is a cross-sectional view taken along line 6-6 of FIG. 2.

With reference to FIGS. 1 and 5, the spout base 24 illustratively includes a lower hub 26 and a spout upper tube 28. The spout base 24 defines a passageway 30 extending along a longitudinal axis 31 and receiving a flexible outlet tube 32. The tubes 20, 22 and 32 may be formed of a conventional material, such as a polymer (illustratively a cross-linked polyethylene (PEX)).

With reference to FIG. 5, a mounting shank 34 illustratively extends downwardly from the lower hub 26 to below the sink deck 12. A mounting nut 36 threadably couples with the mounting shank 34 to clamp the spout base 24 to the sink deck 12. The tubes 20, 22 and 32 may pass from below the sink deck 12, through the mounting shank 34 and into the passageway 30 of the spout base 24.

A manual valve 38 may be supported within the spout base 24 and includes hot and cold water ports (not shown) fluidly coupled to the hot and cold water supply tubes 20 and 22, and a mixed water outlet port (not shown) fluidly coupled to the outlet tube 32. As is known, the manual valve 38 may be a conventional mixing valve including a handle 40 coupled to a valve stem 42 for controlling the flow rate and the temperature of water delivered to the outlet tube 32 from the supply tubes 20 and 22. Illustratively, the outlet tube 32 is fluidly coupled to a pullout sprayhead 44. More particularly, the outlet tube 32 extends downwardly from the manual valve 38 below the sink deck 12 and then loops back upwardly through the spout base 24 to the sprayhead 44.

Figures 7, 7A:
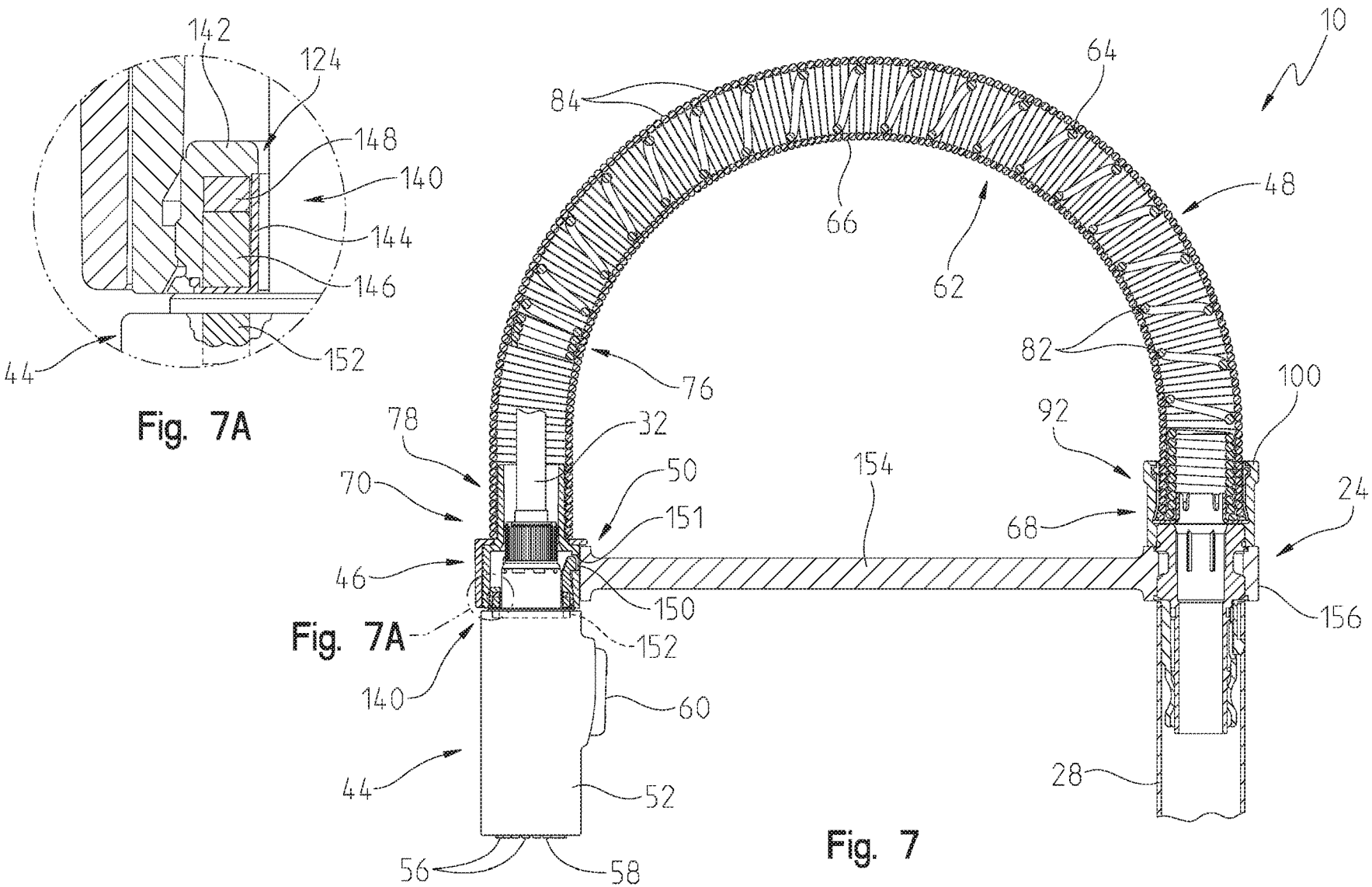
FIG. 7 is a cross-sectional view taken along line 7-7 of FIG. 1.
FIG. 7A is a detailed view of FIG. 7.

The pullout sprayhead 44 is removably coupled to a spout nest 46 which is secured to a delivery spout 48 supported by the spout base 24. In turn, the spout nest 46 is removably coupled to a docking cradle 50 supported by the spout base 24. With reference to FIGS. 5 and 7, the sprayhead 44 may be of conventional design as including an outer shell 52 and an internal waterway 54. The internal waterway 54 is fluidly coupled to the outlet tube 32 for supplying water to outlets defined by the sprayhead 44, illustratively a plurality of circumferentially spaced spray outlets 56 and a central stream outlet 58. A toggle switch 60 may be operably coupled to the internal waterway 54 for alternating flow between the outlets 56 and 58 (FIG. 7).

Figure 8:
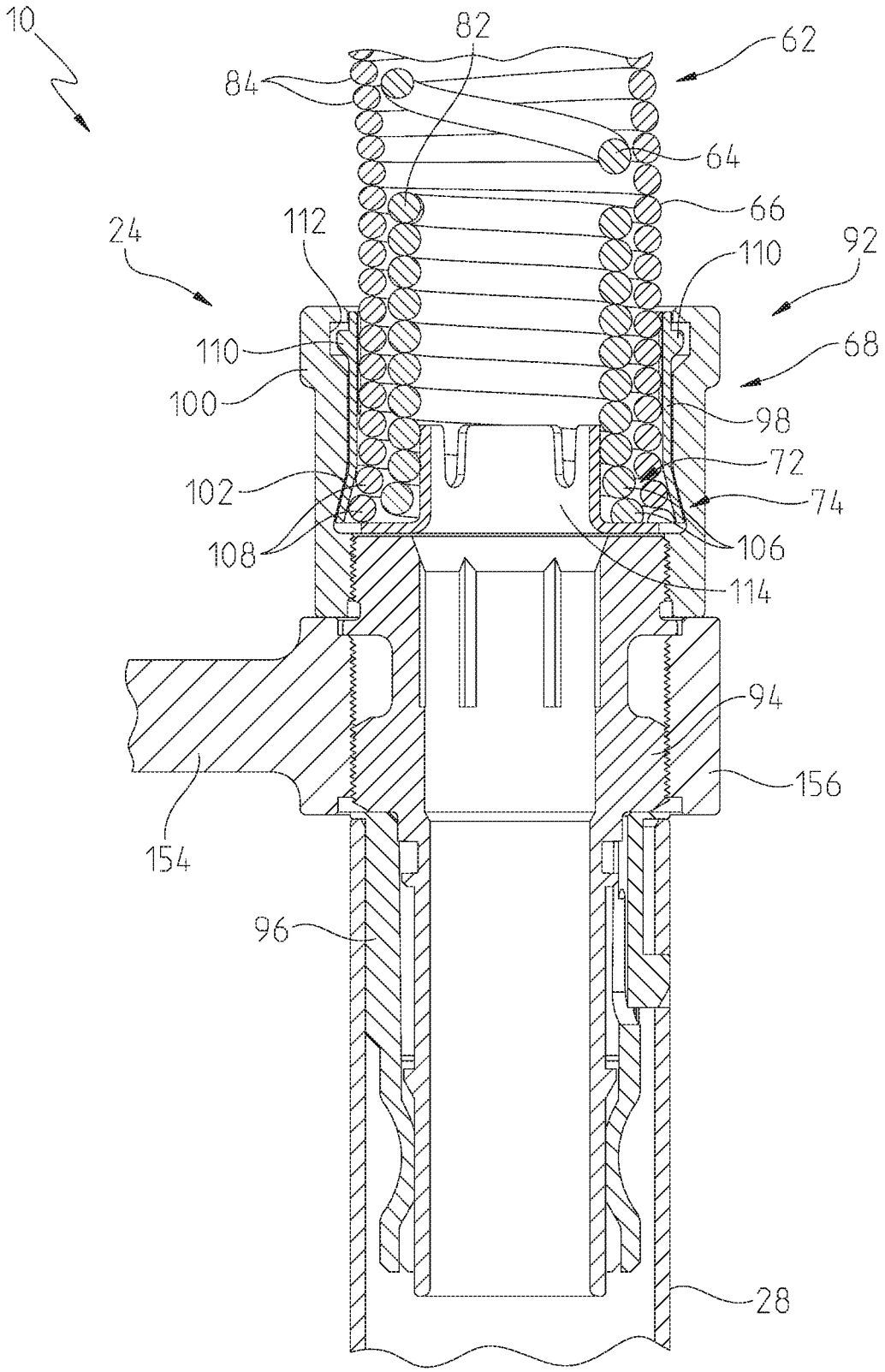
FIG. 8 is a cross-sectional view of the illustrative spout base of FIG. 7.
Figure 9:
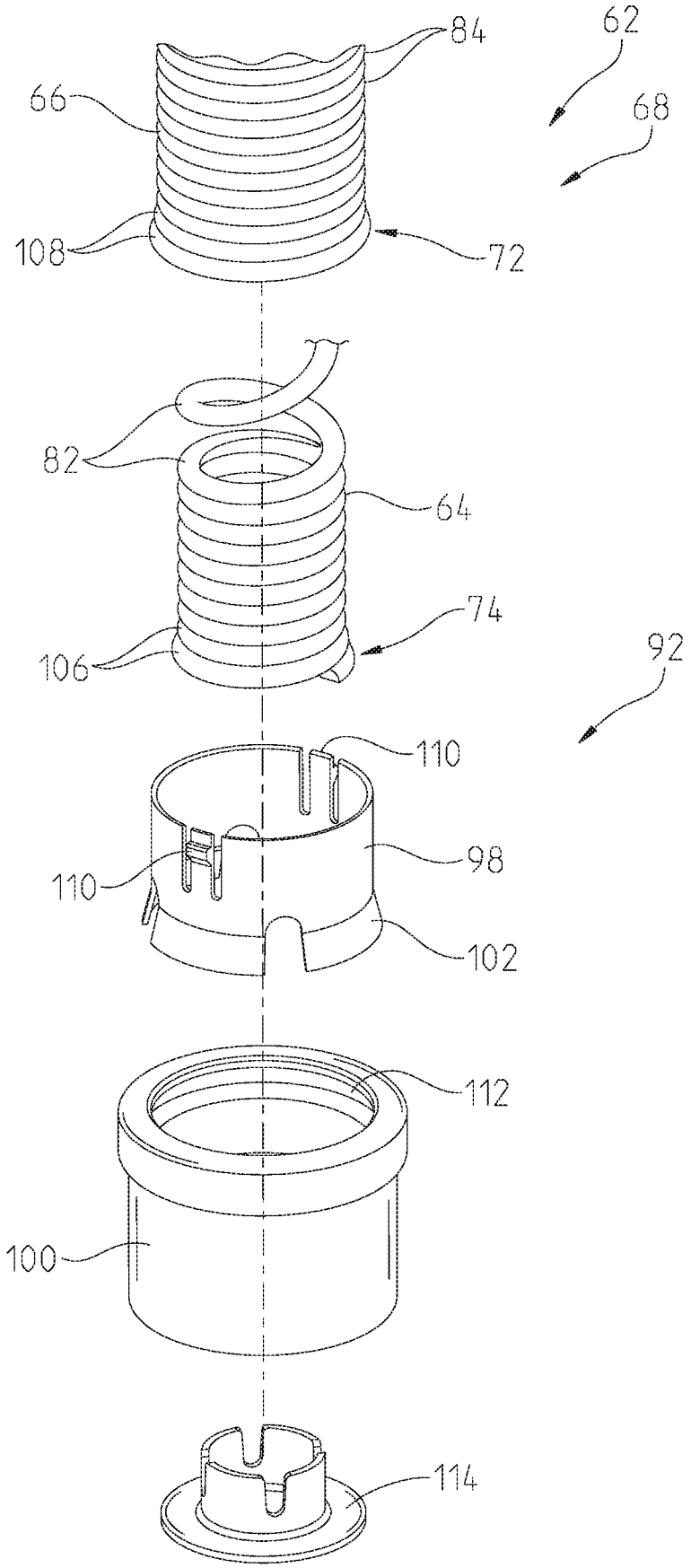
FIG. 9 is a partial exploded perspective view of the illustrative spout base of FIG. 7.
Figure 10:
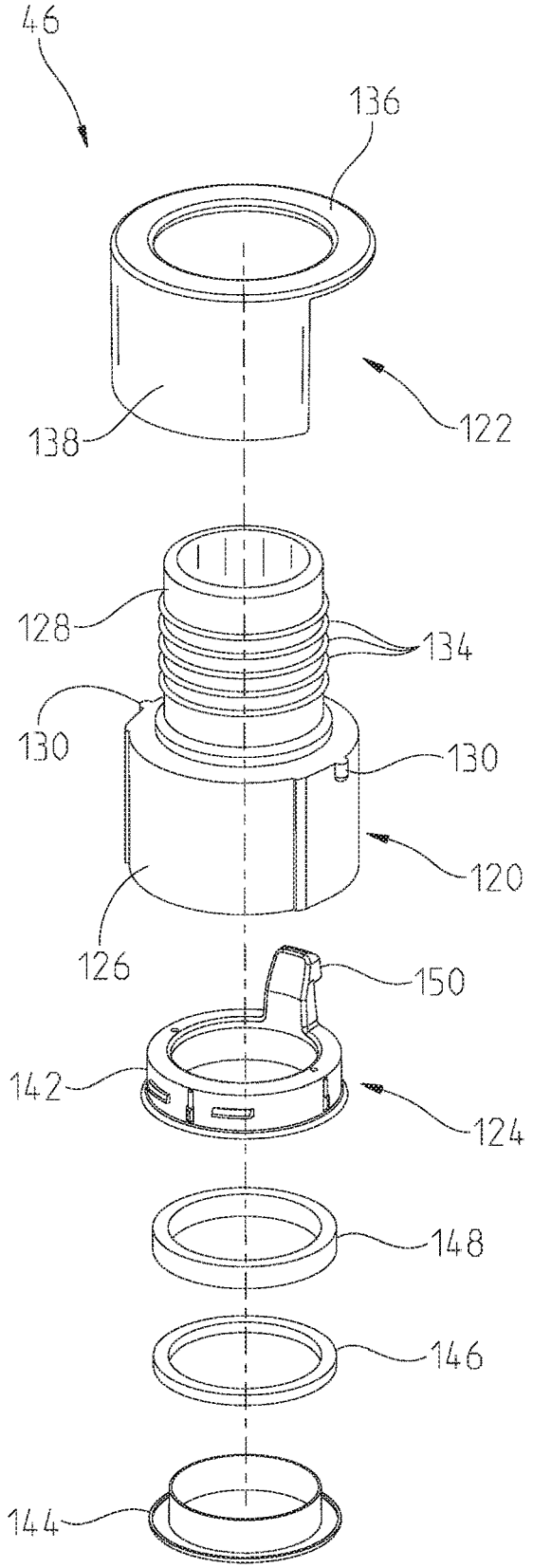
FIG. 10 is a first exploded perspective view of the illustrative spout nest of the faucet of FIG. 1.
Figure 11:
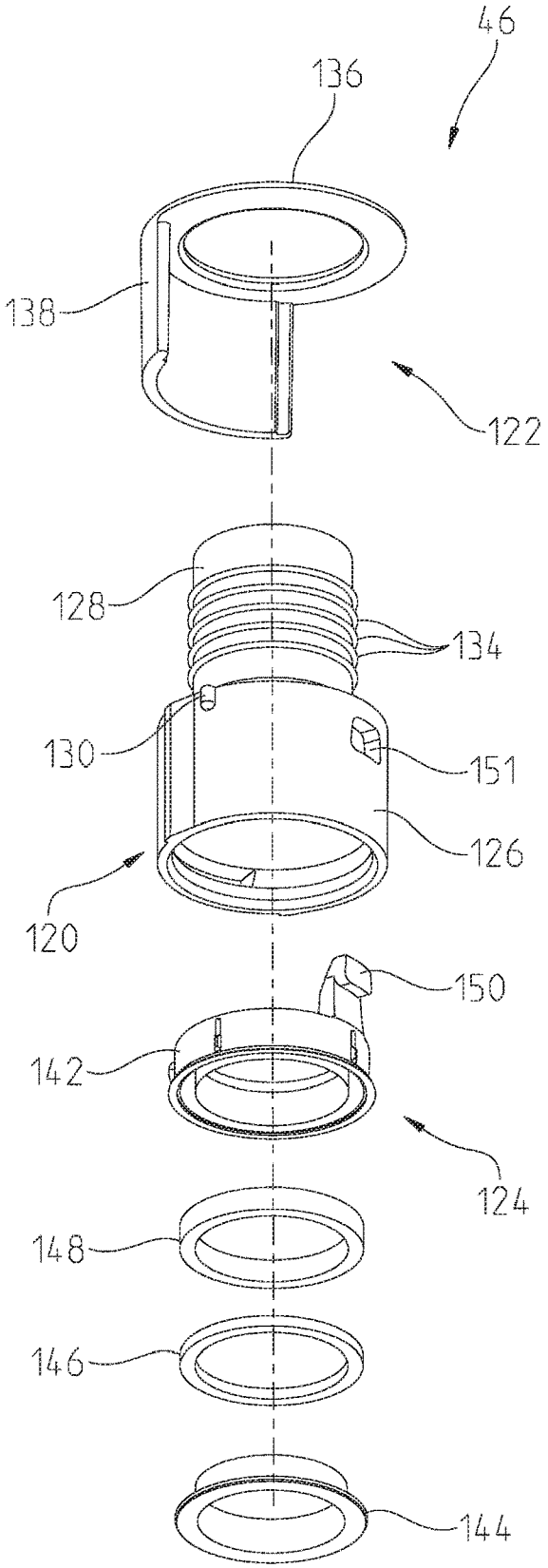
FIG. 11 is a second exploded perspective view of the illustrative spout nest of FIG. 1.

With reference to FIGS. 5, 7 and 8, the delivery spout 48 illustratively comprises a spring spout 62 is supported by the spout base 24. Illustratively, the spring spout 62 includes an inner spring 64 and an outer sleeve 66. The spring spout 62 extends between opposing first and second ends 68 and 70, respectively. The first end 68 of the spring spout 62 is coupled to the spout base 24, and the second end 70 of the spring spout 62 is coupled to the spout nest 46. As further detailed herein, first ends 72 and 74 of the inner spring 64 and the outer sleeve 66 are coupled to the spout base 24. Second end 76 of the inner spring 64 is freely supported within the outer sleeve 66 for relative movement therebetween, while second end 78 of outer sleeve 66 is coupled to the spout nest 46.

The inner spring 64 is illustratively a tension spring including a plurality of metal helical coils 82 surrounding the outlet tube 32. The inner spring 64 defines an arc when in a relaxed state. In operation, the inner spring 64 supports the outlet tube 32 and the spout nest 46 (and the sprayhead 44 when coupled thereto). Moreover, the inner spring 64 is configured to facilitate return of the spout nest 46 to its rest position within the docking cradle 50 (FIG. 1). In this docked position, the spring spout 62 defines an arc within a vertical plane extending through the spout base 24 and the sprayhead 44.

The outer sleeve 66 is illustratively a tension spring including a plurality of tightly wound helical coils 84. The outer sleeve 66 defines is linear when in a relaxed state. The outer sleeve 66 protects the inner spring 64 and the outlet tube 32 from debris and dirt, while providing an aesthetically pleasing appearance. While the outer sleeve 66 is illustratively formed from a plurality of metal coils 84 (such as electro-polished stainless steel), the sleeve 66 may be formed of other materials, such as a flexible casing or tube formed of a polymer (such as a plated polymer).

The outlet tube 32 is supported for sliding movement within the spout base 24 and the spring spout 62. More particularly, the outlet tube 32 slides within the spout base 24 and the spring spout 62 as the sprayhead 44 is moved relative to the spout nest 46. In other words, the outlet tube 32 slides within the spout base 24 and the spring spout 62 as the sprayhead 44 is undocked or uncoupled from the spout base 24 and moved (i.e., pulled or retracted) relative thereto (for example, between the positions in FIG. 1 and FIG. 2).

As shown in FIG. 1, an illustrative retractor or a hose weight 90 is slidably mounted on the outlet tube 32 and is configured to help retract the outlet tube 32 back into the rest position as shown in FIG. 1 after the sprayhead 44 has been removed from the spout nest 46. The hose weight 90 may be of conventional design, such as the hose weight disclosed in US Patent Application Publication No. 2009/0145492 to Thomas et al, the disclosure of which is expressly incorporated herein by reference.

As further detailed herein, the sprayhead 44 is fluidly coupled to the outlet tube 32, and is releasably coupled or secured to the spout nest 46. The docking cradle 50 is supported by the spout base 24 and releasably couples to the spout nest 46.

With reference to FIGS. 5 and 7-9, the first end 68 of the spring spout 62 is secured to the spout base 24 through a spout base coupling 92. The spout base coupling 92 illustratively includes a spring spout connector, illustratively a downwardly extending connector tube 94, rotatably secured within the spout upper tube 28 by a retainer such as a retaining sleeve 96. A spring glide bushing 98 cooperates with a spring spout hub nut 100 and to secure the first end 68 of the spring spout 62 to the upper tube 28 of the spout base 24.

The spring spout hub nut 100 is threadably coupled to the spring spout connector 94. As the spring spout hub nut 100 is threaded onto the spring spout connector 94, tapered walls 102 of the bushing 98 secure outwardly flared end coils 106 and 108 of the inner spring 64 and the outer sleeve 66, respectively, of the spring spout 62. The bushing 98 includes a pair of diametrically opposed flexible tabs 110 received within an annular groove 112 formed within the spring spout hub nut 100, thereby axially securing the bushing 98 with the spring spout hub nut 100. A spring spout washer 114 is secured to the first end 72 of the inner spring 64 and prevents metal to metal contact between the inner spring 64 and the spring spout connector 94.

With reference to FIGS. 5-7A, 10 and 11, the spout nest 46 illustratively includes a main body 120, a cover 122 and a sprayhead retainer 124. The main body 120 illustratively includes a cylindrical base 126 and an upper connector 128. The base 126 includes a pair of diametrically opposed tabs 130 configured to be received within slots 132 formed in the docking cradle 50. The upper connector 128 includes a plurality of concentric ribs 134 that retain the coils 84 at the second end 78 of the outer sleeve 66.

The cover 122 illustratively includes an upper annular lip 136 and a downwardly extending arcuate outer wall 138. The upper connector 128 of the main body 120 is received within the upper annular lip 136. Illustratively, the main body 120 and the cover 122 are formed of polymers secured together through conventional means, such as adhesives, ultrasonic welding, heat staking, etc. For example, the main body 120 may be formed of an acetal copolymer (e.g., Celcon® M90), and the cover 122 may be formed of a plated acrylonitrile butadiene styrene (ABS). In other illustrative embodiments, the main body 120 and the cover 122 may be formed of a single component, such as a molded polymer or a machined brass including a plated outer surface.

The sprayhead retainer 124 illustratively defines a magnetic coupling 140 to releasably couple the sprayhead 44 to the spring spout 62 through the spout nest 46. While a magnetic coupling 140 is shown in the illustrative embodiment, other conventional couplings may be substituted therefor, including spring fingers and bayonet couplings.

In the illustrative embodiment, the sprayhead retainer 124 includes an outer holder 142 and an inner base 144 that secure a magnet 146 and a backing plate 148. The magnet 146 may be a permanent magnet, illustratively formed of a ferromagnetic material, such as iron, nickel, cobalt, or alloys of rare earth metals. In certain illustrative embodiments, the magnet 146 may be formed of neodymium. The backing plate 148 is configured to direct magnetic fields from the magnet 146 and thereby increase the attractive force of a magnetic coupling 140. A tab or clip 150 is illustratively received within an opening 151 to secure the sprayhead retainer 124 to the main body 120. A magnetically attractive element 152 (e.g., a metal washer) is supported by the sprayhead 44. The magnet 146 and the magnetically attractive element 152 may be coated, plated or overmolded (e.g., by a polymer) for protection from moisture. Illustratively, the magnetic coupling 140, including the sprayhead retainer 124 and the magnetically attractive element 152, may be similar to that disclosed in U.S. Pat. No. 8,496,028 to Nelson et al., the disclosure of which is expressly incorporated herein by reference.

Illustratively, the docking cradle 50 is rotatably coupled to the spout base 24 by a horizontal swing arm 154. More particularly, a collar 156 is threadably coupled to the spring spout connector 94. The spring spout connector 94 is rotatably supported within the retainer received within the spout upper tube 28.

The docking cradle 50 illustratively includes a c-shaped retainer 158 including opposing arms 160*a* and 160*b*. Each arm 160*a*, 160*b* includes a vertical slot 132 configured to receive tabs 130 of the spout nest 46. When the spout nest 46 is coupled to the retainer 158, the arcuate outer wall 138 of the cover 122 is received within an opening 162 defined between ends of the opposing arms 160*a*, 160*b*, and the annular lip 136 of the cover 122 rests on an upper edge 164 of the retainer 158. Engagement between the tabs 130 and slots 132 rotationally orient and secure the spout nest 46 relative to the retainer 158. In certain illustrative embodiments, other couplings, such as frictional interference, magnetic couplings, and/or spring tabs may be used to further secure the spout nest 46 to the docking cradle 50.

Figure 12:
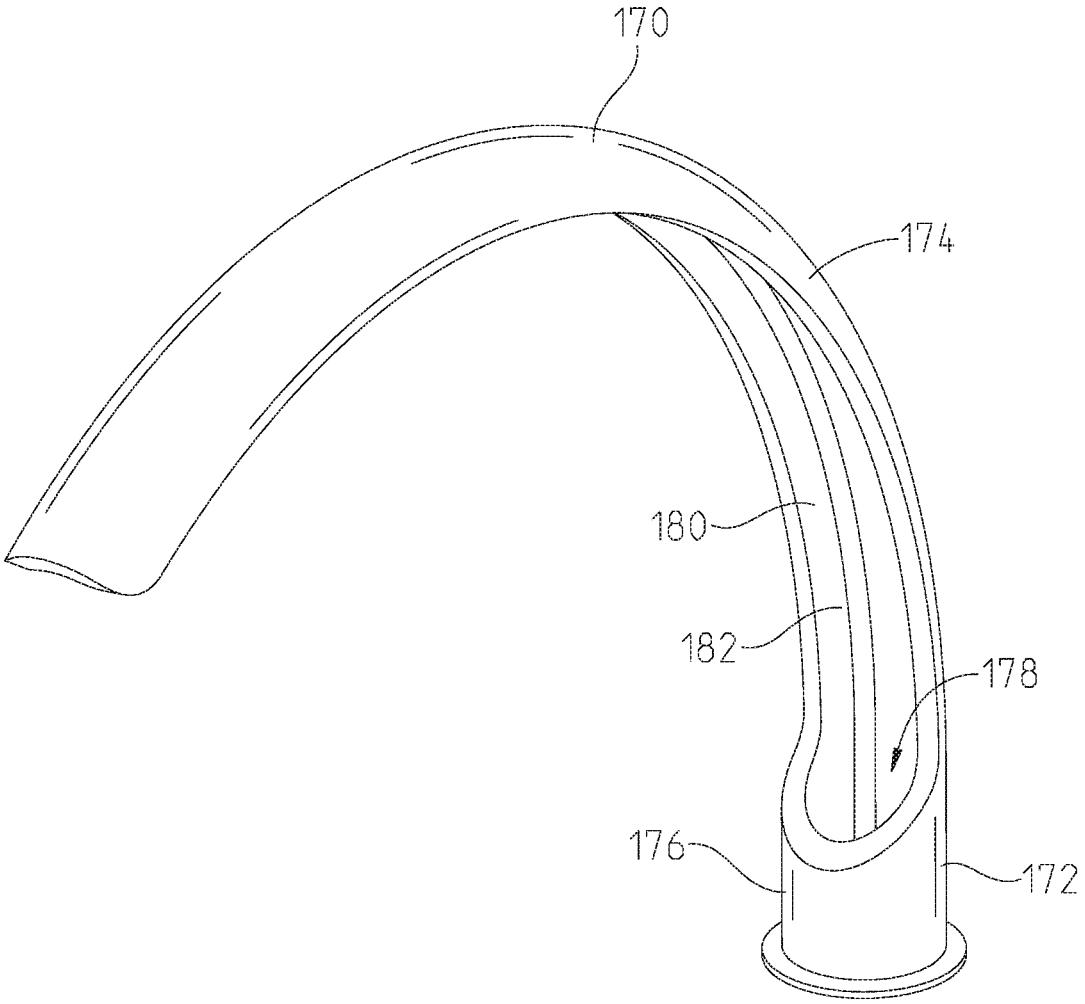
FIG. 12 is a perspective view of a spring spout hose guide according to a further illustrative embodiment of the present disclosure.
Figure 13:
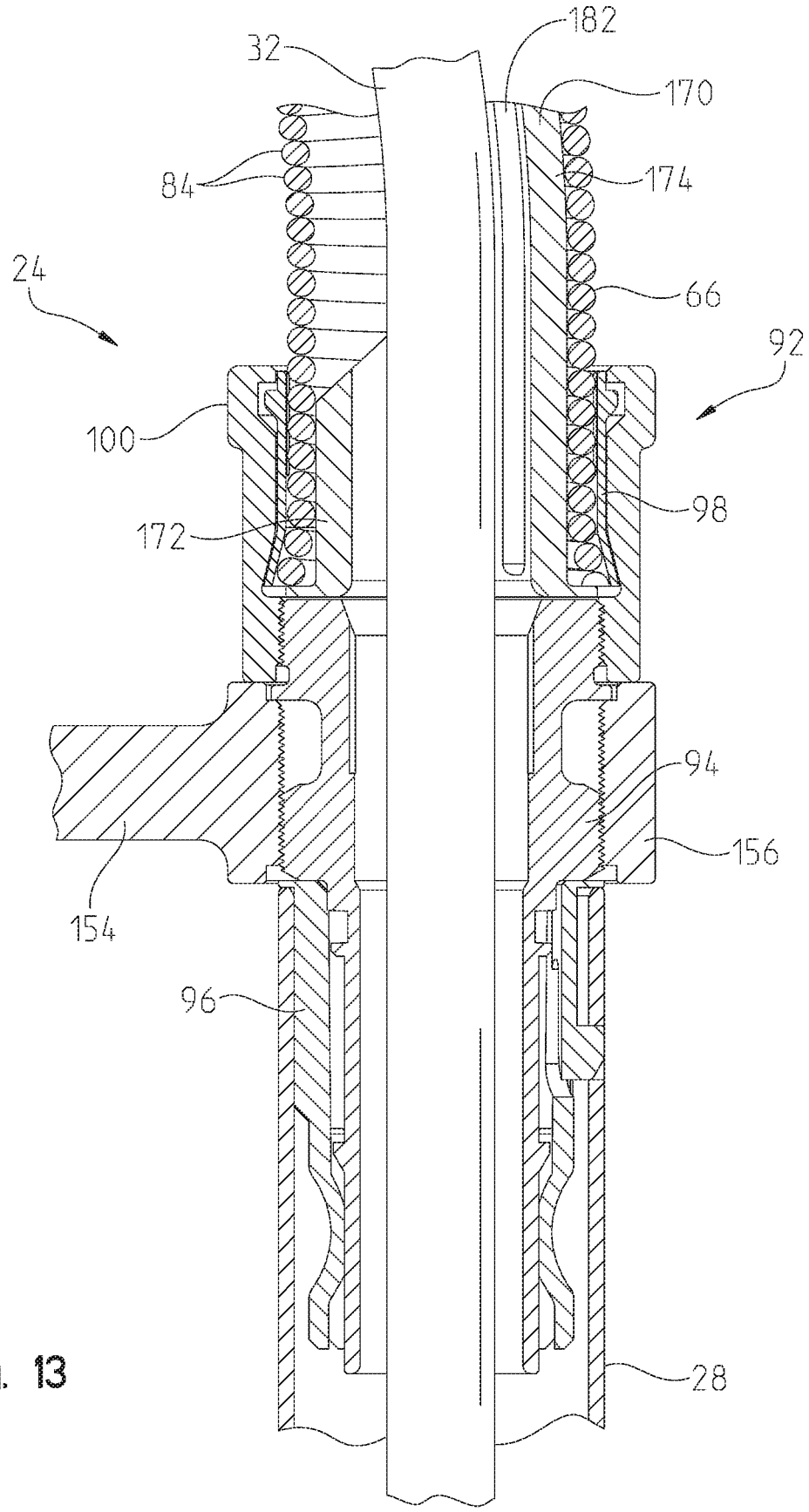
FIG. 13 is a partial cross-sectional view of the illustrative spout base showing the spring spout hose guide of FIG. 12.

With reference now to FIGS. 12 and 13, in a further illustrative embodiment, the inner spring 64 may be replaced with a spring spout hose guide 170. The spring spout hose guide 170 illustratively includes a base 172 supporting an upwardly extending guide portion 174. The base 172 includes a cylindrical wall 176 defining a central opening 178 to receive the outlet tube 32. The guide portion 174 includes an arcuate wall 180 defining a groove 182 for receiving the outlet tube 32. The arcuate wall 180 is curved in perpendicular axes. The hose guide 170 is illustratively formed of a flexible polymer, such as a polypropylene.

As shown in FIG. 13, the base 172 of the hose guide 170 is coupled to the spout base 24. The outer sleeve 66 is illustratively received over the guide portion 174 of the hose guide 170. More particularly, the spout base coupling 92 illustratively couples the hose guide 170 and the outer sleeve 66 to the spout base 24 through the spring spout connector 94.

Figure 2:
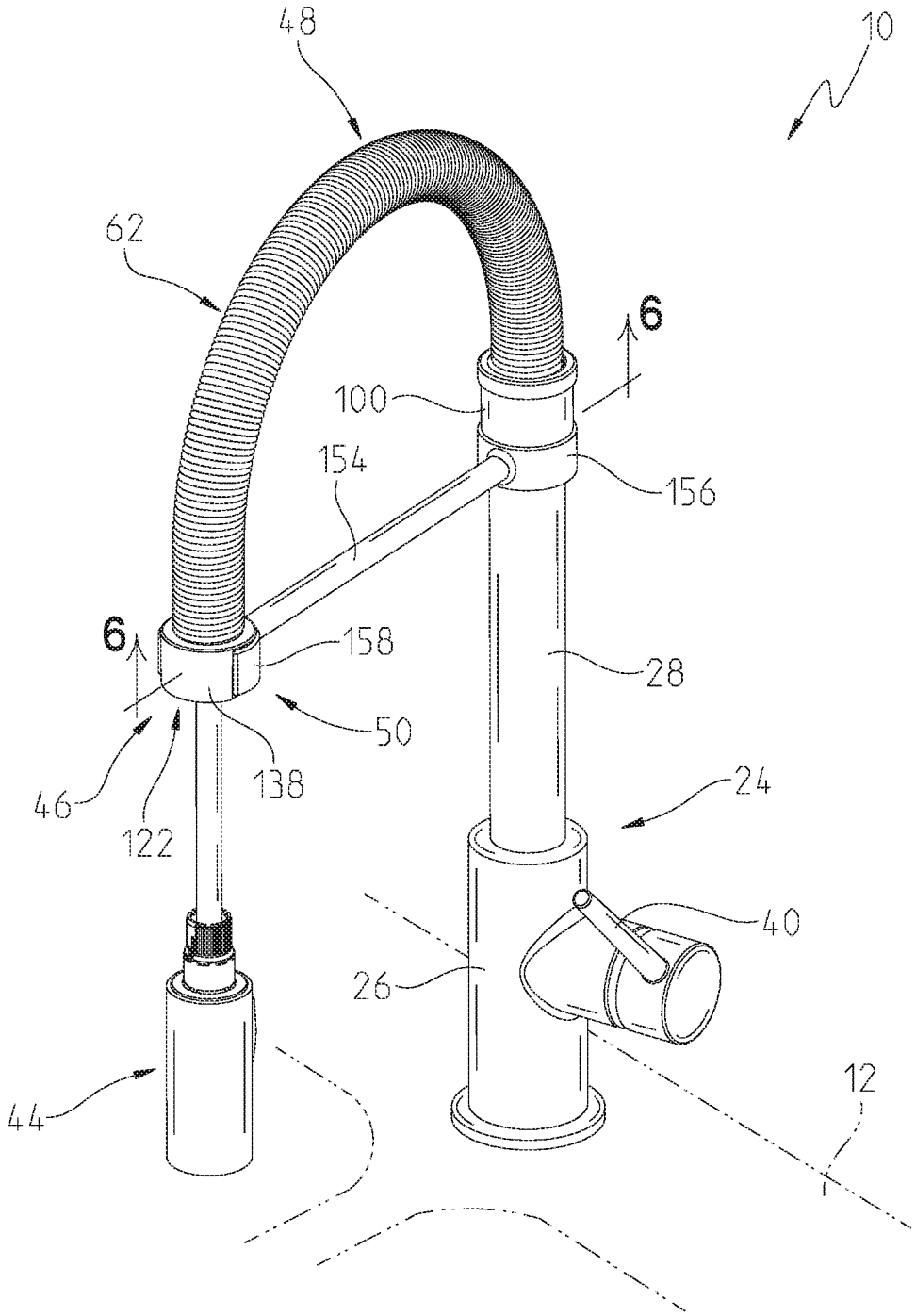
FIG. 2 is a perspective view of the kitchen faucet of FIG. 1, showing the spout nest coupled to the docking cradle, and the pulldown sprayhead removed from the spout nest.

The illustrative kitchen faucet 10 has a plurality of different modes of operation. In an illustrative first mode of operation as shown in FIG. 1, the spout nest 46 is initially coupled to the docking cradle 50, and the sprayhead 44 is coupled to the spout nest 46. In an illustrative second mode of operation as shown in FIG. 2, the spout nest 46 is coupled to the docking cradle 50, and the sprayhead 44 is removed from the spout nest 46. In this mode of operation, the kitchen faucet 10 operates as a conventional pulldown faucet.

Figure 3:
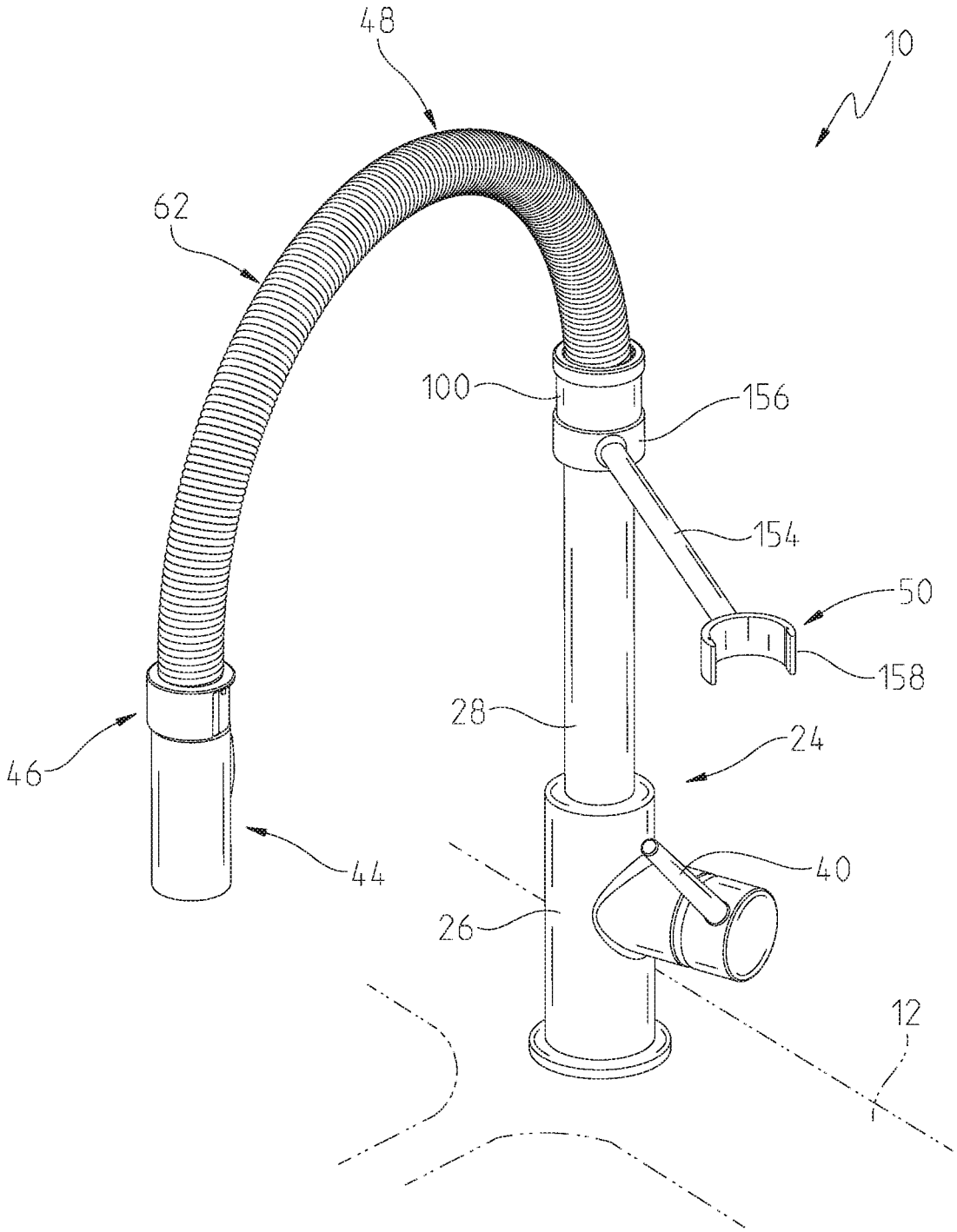
FIG. 3 is a perspective view of the kitchen faucet of FIG. 1, showing the spout nest removed from the docking cradle, the pulldown sprayhead coupled to the spout nest, and the docking cradle rotated about the spout base.
Figure 4:
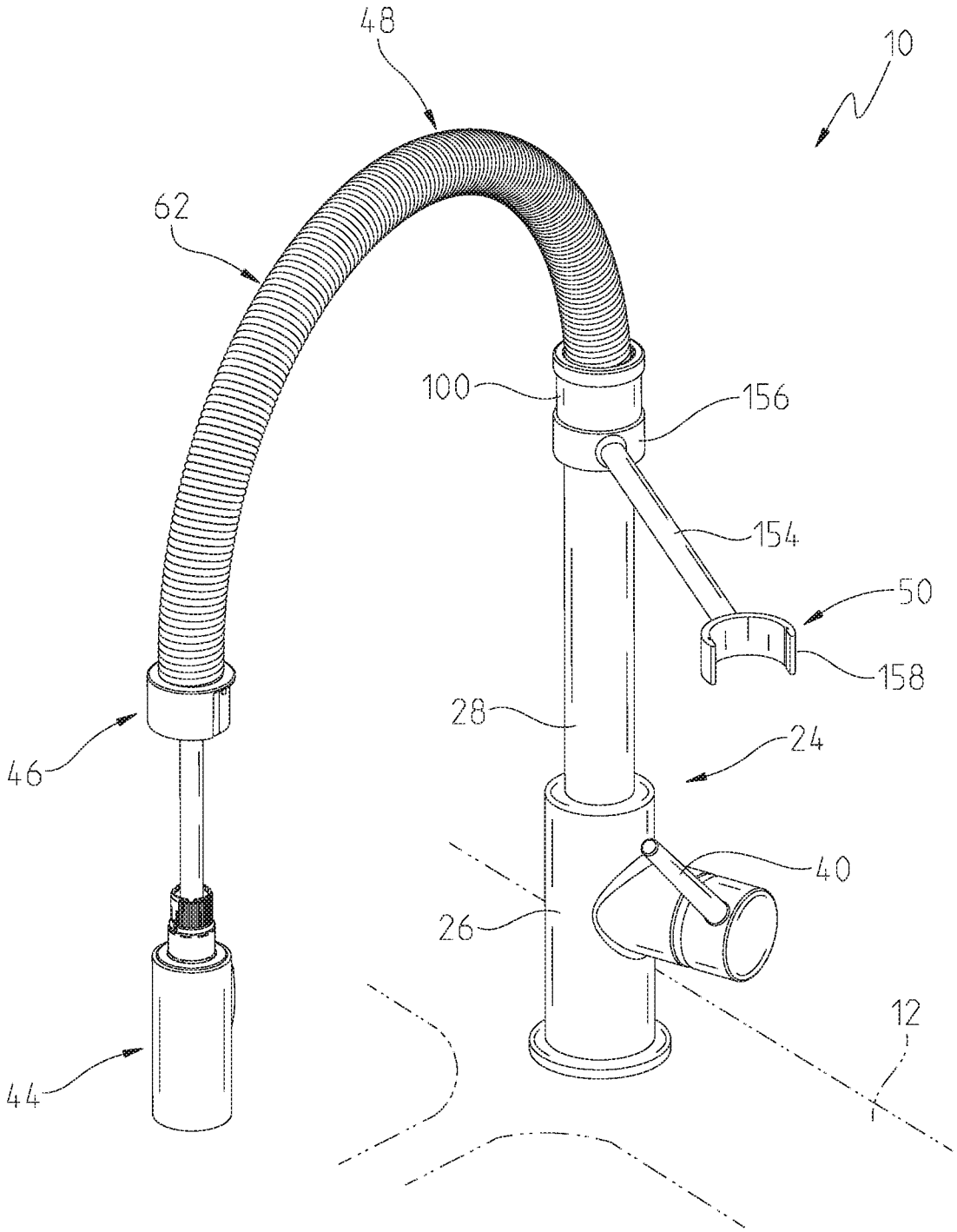
FIG. 4 is a perspective view of the kitchen faucet of FIG. 1, showing the spout nest removed from the docking cradle, the pulldown sprayhead removed from the spout nest, and the docking cradle rotated about the spout base.

In an illustrative third mode of operation as shown in FIG. 3, the spout nest 46 is removed from the docking cradle 50, and the sprayhead 44 is coupled to the spout nest 46. In this mode of operation, the kitchen faucet 10 may be operated as a conventional spring spout. In an illustrative fourth mode of operation as shown in FIG. 4, the spout nest 46 is removed from the docking cradle 50, and the sprayhead 44 is removed from the spout nest 46.

Figure 14:
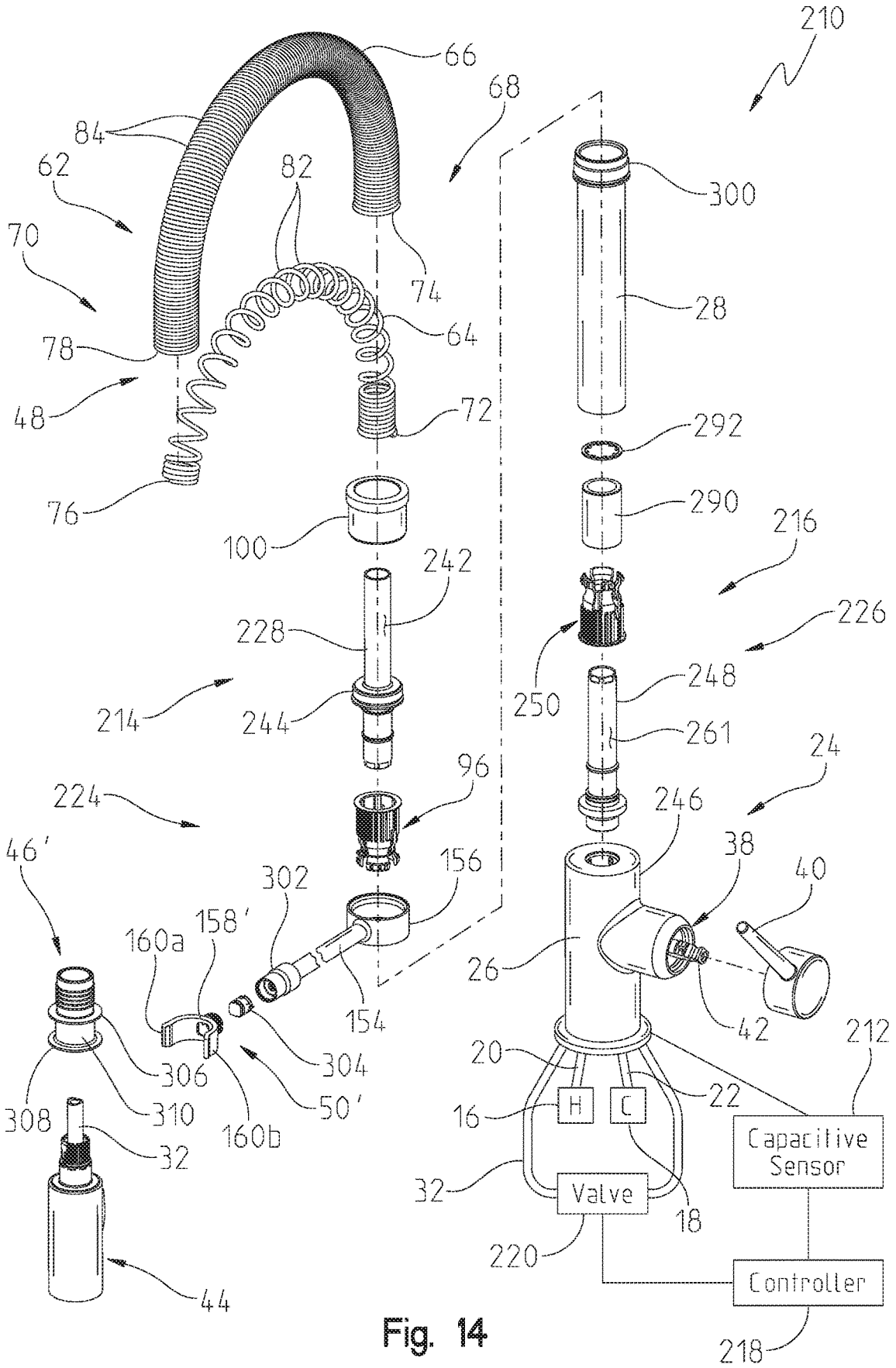
FIG. 14 is an exploded perspective view of a further illustrative kitchen faucet of the present disclosure.

With reference now to FIG. 14, a further illustrative kitchen faucet 210 is shown as including many of the same features of kitchen faucet 10. As such, in the following description similar components will be identified with like reference numbers.

The illustrative kitchen faucet 210 illustratively includes a capacitive sensor 212 operably coupled to the upper delivery spout 48 by a first or upper capacitive coupling 214 and a second or lower capacitive coupling 216. The capacitive sensor 212 is illustratively operably coupled to a controller 218. An actuator driven valve 220 is in electrical communication with the controller 218 and controls fluid flow from the manual valve 38 through the outlet tube 32. More particularly, a user's hand in contact with and/or in proximity to the faucet 210 is illustratively detected by the capacitive sensor 212 and causes the controller 218 to open the actuator driven valve 220. Illustratively, the actuator driven valve 220 is an electrically operable valve, such as a solenoid valve.

Because the actuator driven valve 220 is controlled electronically by controller 218, flow of water can be controlled using an output from the capacitive sensor 212. As shown in FIG. 14, when the actuator driven valve 220 is open, the faucet 210 may be operated in a conventional manner, i.e., in a manual control mode through operation of the handle 40 of the manual valve 38. Conversely, when the manual valve 38 is set to select a water temperature and flow rate, the actuator driven valve 220 can be touch controlled using the capacitive sensor 212 as a touch sensor, or activated by using the capacitive sensor 212 as a proximity sensor when an object (such as a user's hands) are within a detection zone or area to toggle water flow on and off.

More particularly, the output signal from the capacitive sensor 212 may be used to control actuator driven valve 220 which thereby controls flow of water to the outlet tube 32 from the hot and cold water sources 16 and 18. By sensing capacitance changes with capacitive sensor 212, the controller 218 can make logical decisions to control different modes of operation of faucet 210 such as changing between a manual mode of operation and a hands free mode of operation. Additional details regarding capacitive sensing systems and methods for operating faucets may be found, for example, in U.S. Pat. No. 8,561,626 to Sawaski et al., U.S. Pat. No. 7,690,395 to Jonte et al., U.S. Pat. No. 7,150,293 to Jonte; and U.S. Pat. No. 8,613,419 to Rodenbeck et al., the disclosures of which are all expressly incorporated herein by reference.

Kitchen faucet 210 illustratively includes spout base 24 having lower hub 26 and spout upper tube 28. A first or upper pivot coupling 224 is defined between the upper delivery spout 48 and the spout upper tube 28, while a second or lower pivot coupling 226 is defined between the lower hub 26 and the spout upper tube 28.

With reference to FIGS. 14-18, the upper pivot coupling 224 illustratively includes a downwardly extending connector tube 228 rotatably supported within an upper end of the spout upper tube 28 by retaining sleeve 96. Retaining sleeve 96 is illustratively fixed within the spout upper tube 28 while rotatably receiving the downwardly extending connector tube 228.

More particularly, the retaining sleeve 96 includes a distal cylindrical side wall 230 and a plurality of proximal arms 232. The side wall 230 illustratively includes a plurality of circumferentially spaced, radially outwardly extending ribs 234 configured to frictionally engage with an inner surface 236 of the spout upper tube 28, thereby securing the retaining sleeve 96 to the spout upper tube 28. A tab 238 may be biased radially outwardly to engage a recess or opening 240 formed within a side wall 241 of the spout upper tube 28 to further secure the retaining sleeve 96 therewithin. The proximal arms 232 are illustratively biased radially inwardly to engage an outer surface 242 of the connector tube 228. The retaining sleeve 96 is illustratively formed of a polymer, such as an acetal copolymer (e.g., Celcon® M90).

Spring spout hub nut 100 is illustratively threaded onto an annular ring 244 of the downwardly extending connector tube 228 to secure the first end 68 of the spring spout 62 for rotation relative to the spout upper tube 28. More particularly, the first end 68 of the spring spout 62 is secured to the connector tube 228 for rotation therewith relative to the spout upper tube 28.

The lower hub 26 illustratively includes a base 246 and an upwardly extending connector tube 248 fixed to the base 246. The lower pivot coupling 226 illustratively includes the upwardly extending connector tube 248 rotatably supported within a lower end of the spout upper tube 28 by a retaining sleeve 250. Retaining sleeve 250 is substantially identical to the retaining sleeve 96 as detailed above. Retaining sleeve 250 is illustratively fixed within the spout upper tube 28 while rotatably receiving the upwardly extending connector tube 248.

More particularly, the retaining sleeve 250 includes a distal cylindrical side wall 252 and a plurality of proximal arms 254. The side wall 252 illustratively includes a plurality of circumferentially spaced, radially outwardly extending ribs 256 configured to frictionally engage with an inner surface 236 of the spout upper tube 28, thereby securing the retaining sleeve 250 to the spout upper tube 28. A tab 258 may be biased radially outwardly to engage a recess or opening 260 formed within the side wall 241 of the spout upper tube 28 to further secure the retaining sleeve 250 therewithin. The proximal arms 254 are illustratively biased radially inwardly to engage an outer surface 261 of the connector tube 248. The retaining sleeve 250 is illustratively formed of a polymer, such as an acetal copolymer (e.g., Celcon® M90).

Figure 15:
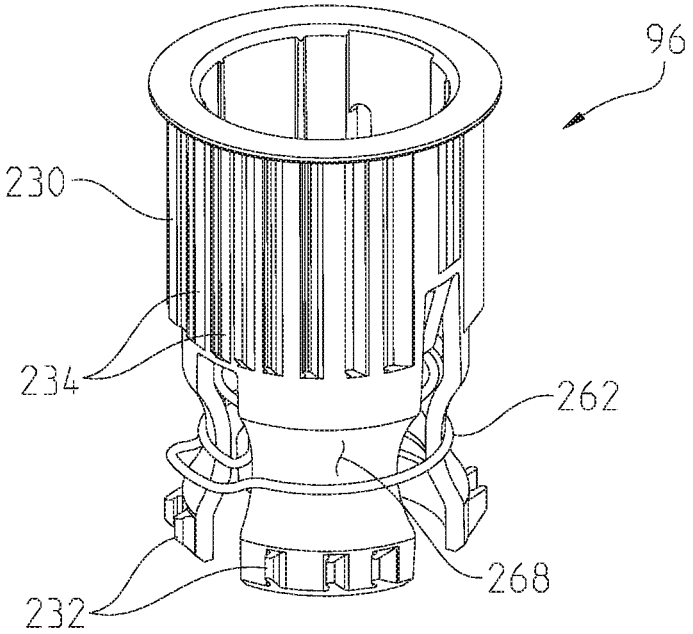
FIG. 15 is a perspective view of an upper retaining sleeve and wire contact.
Figure 16:
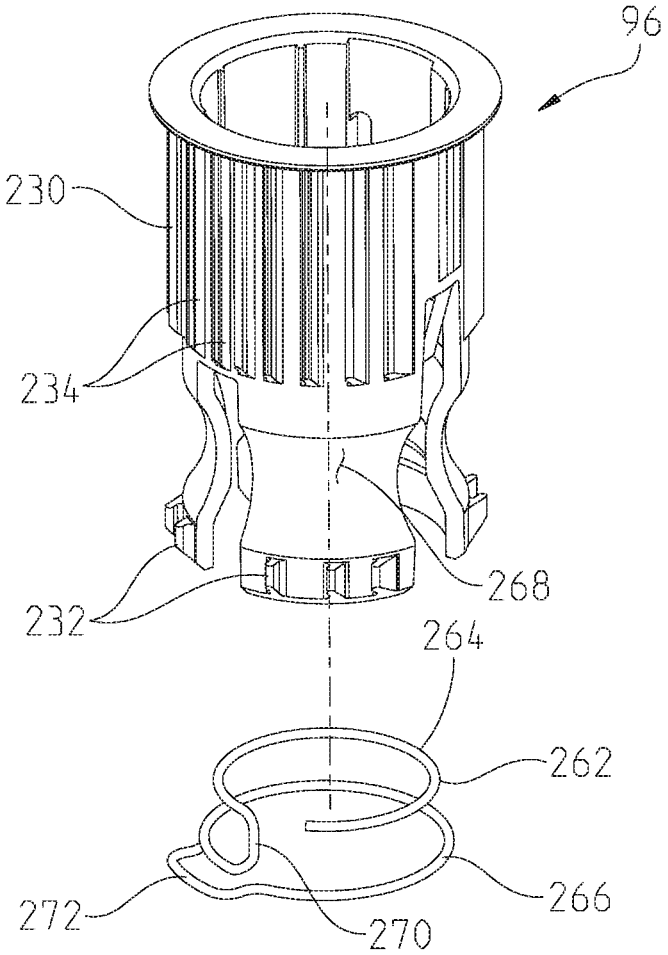
FIG. 16 is an exploded perspective view of the upper retaining sleeve and contact of FIG. 15.

With further reference now to FIGS. 15 and 16, the illustrative upper capacitive coupling 214 is shown as including a wire contact 262 having first and second coils 264 and 266 wrapped around an outer surface 268 of the proximal arms 232 of the retaining sleeve 96. The wire contact 262 defines an inner protrusion or portion 270 and an outer protrusion or portion 272. The wire contact 262 is illustratively formed of an electrically conductive material, such as a metal. The inner portion 270 is configured to contact the outer surface 242 of the downwardly extending connector tube 228, while the outer portion 272 is configured to contact the inner surface 236 of the spout upper tube 28. An enhanced electrical connection, and more particularly an enhanced capacitive coupling 214 at the upper pivot coupling 224, is facilitated by contact between the spout upper tube 28 and the downwardly extending connector tube 228 as provided by the wire contact 262.

Figure 19:
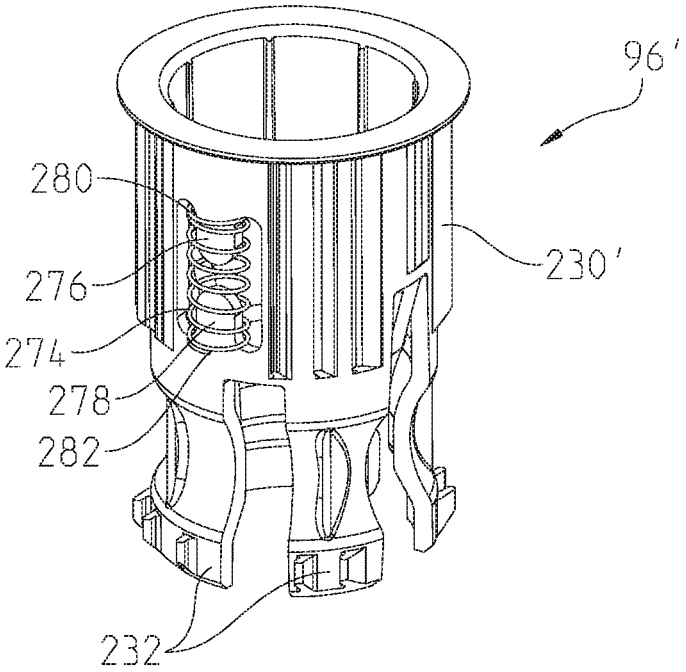
FIG. 19 is a perspective view of an alternative embodiment upper retaining sleeve and spring contact.
Figure 20:
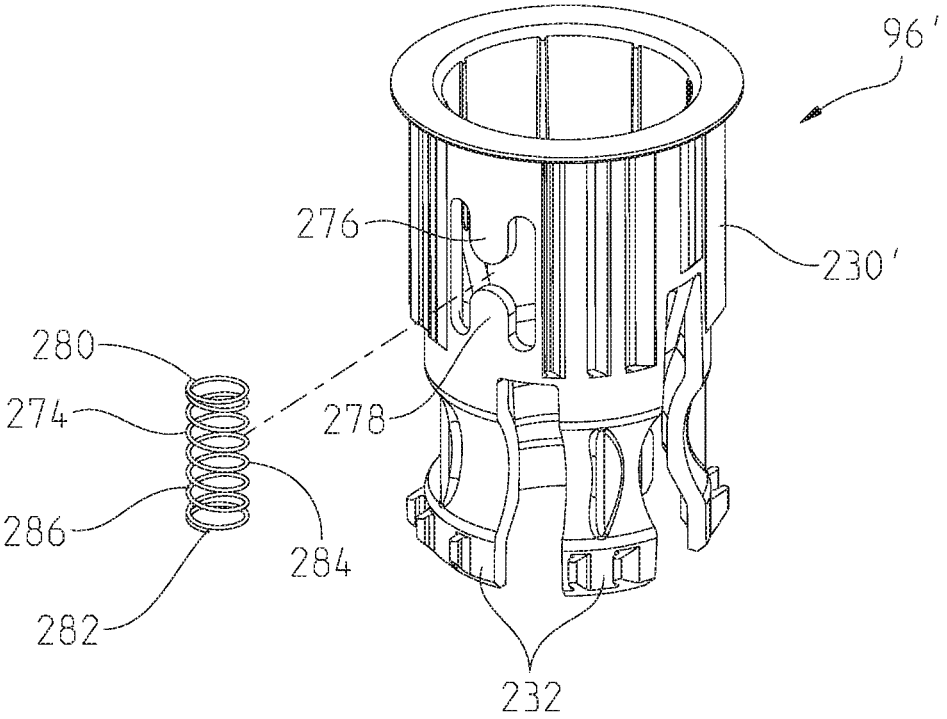
FIG. 20 is an exploded perspective view of the upper retaining sleeve and spring contact of FIG. 19.
Figure 21:
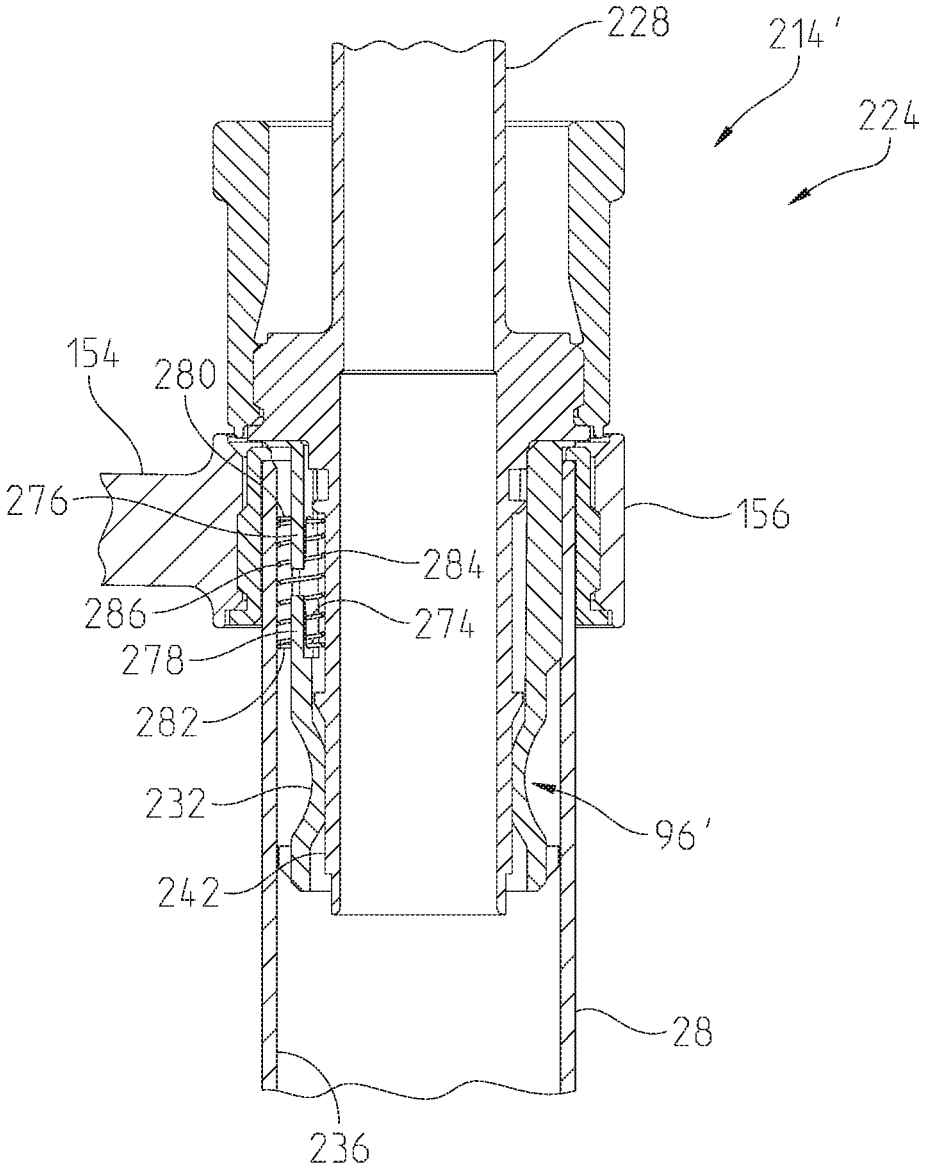
FIG. 21 is a longitudinal cross-sectional view of the upper retaining sleeve and spring contact of FIG. 19.

With reference now to FIGS. 19-21, an alternative embodiment upper capacitive coupling 214' is shown as including a spring contact 274. More particularly, an alternative embodiment retaining sleeve 96' includes a cylindrical sidewall 230' supporting opposing upper and lower posts 276 and 278. The spring contact 274 extends axially between upper and lower ends 280 and 282. The upper end 280 of the spring contact 274 receives the upper post 276, and the lower end 282 of the spring contact 274 receives the lower post 278. The spring contact 274 is illustratively formed of an electrically conductive material, such as a metal.

An inner portion 284 of the spring contact 274 contacts the outer surface 242 of the downwardly extending connector tube 228, while an outer portion 286 of the spring contact 274 contacts the inner surface 236 of the spout upper tube 28. The spring contact 274 is configured for an interference fit between the connector tube 228 and the spout upper tube 28 to maintain an electrical connection therebetween. As the connector tube 228 and the spout upper tube 28 rotate relative to each other about the upper pivot coupling 224, the spring contact 274 is configured to rotate about the upper and lower posts 276 and 278.

Figure 17:
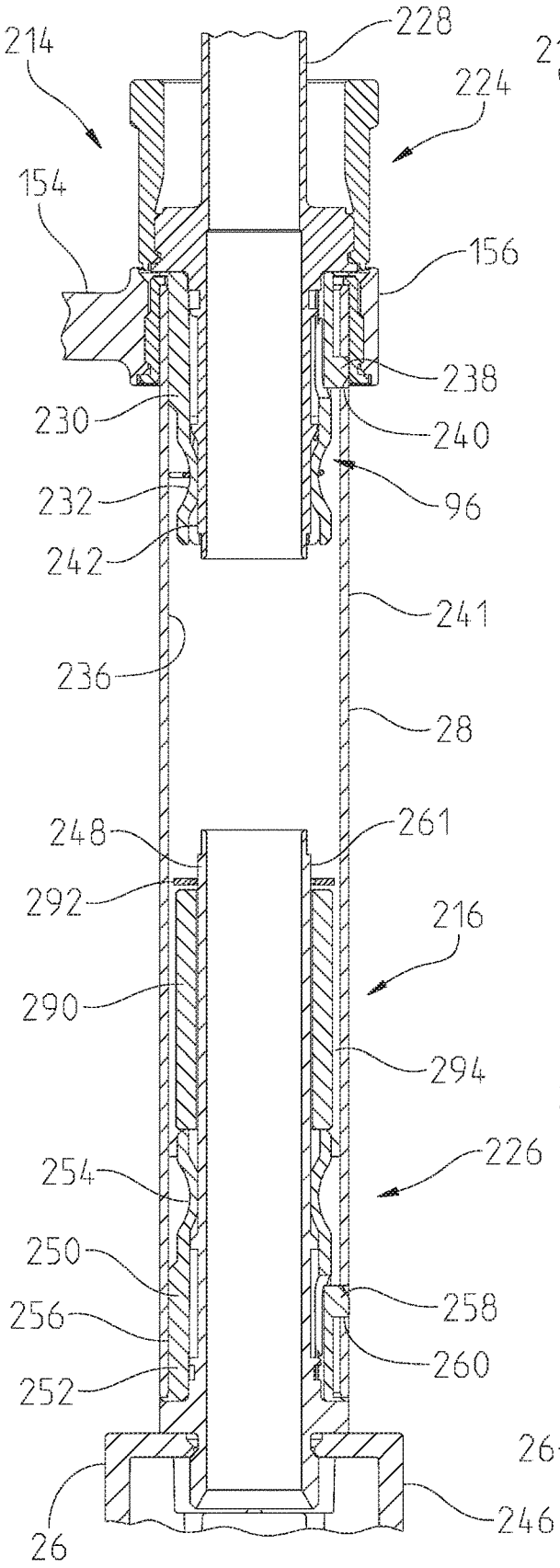
FIG. 17 is a longitudinal cross-sectional view along the spout upper tube of the kitchen faucet of FIG. 14, showing the lower pivot coupling, the lower capacitive coupling, the upper pivot coupling, and the upper capacitive coupling.

With further reference to FIGS. 14 and 17, the lower capacitive coupling 216 illustratively includes a sleeve or bushing 290 retained on the upwardly extending connector tube 248 by a keeper or retaining washer 292. The bushing 290 is illustratively formed of an electrically conductive material, such as a metal. The bushing 290 increases the effective outer surface area of the upwardly extending connector tube 248, and reduces the gap 294 between the outer surface of the upwardly extending connector tube 248 and the inner surface of the spout upper tube 28, thereby providing for an enhanced electrical connection, and more particularly for an enhanced lower capacitive coupling 216.

Figure 18:
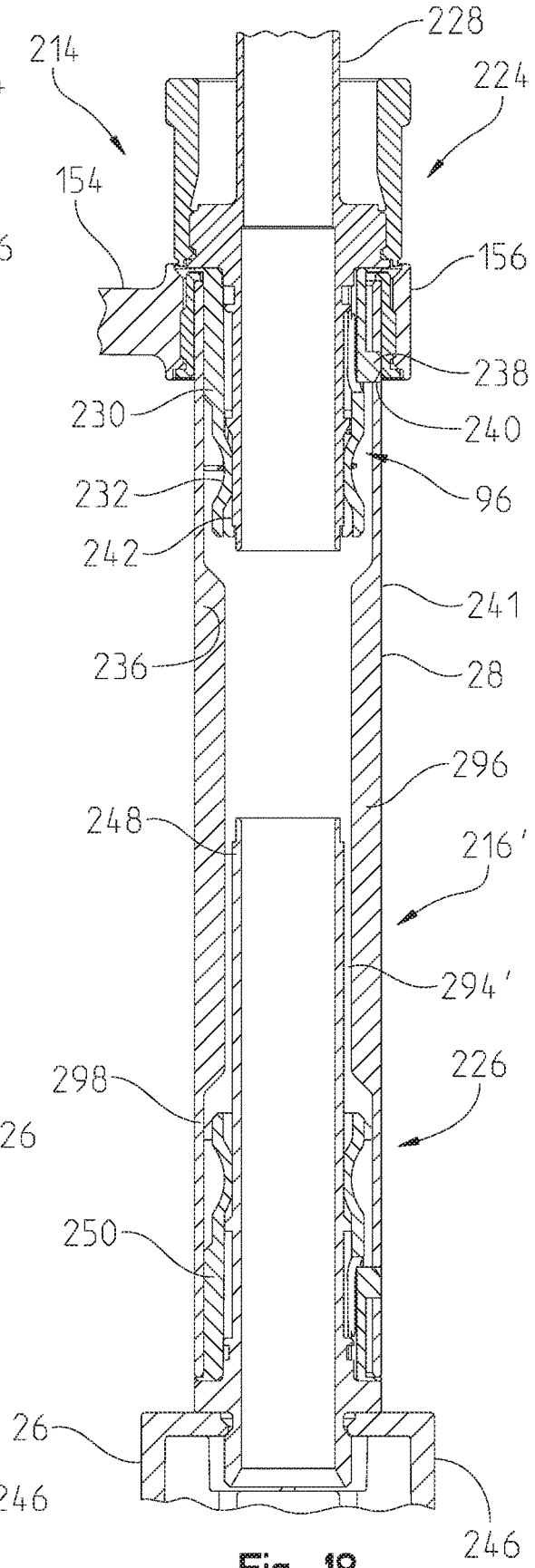
FIG. 18 is a longitudinal cross-sectional view similar to FIG. 17, showing an alternative embodiment lower capacitive coupling.

With reference to FIG. 18, in an alternative embodiment of the lower capacitive coupling 216', a portion 296 of a sidewall 298 of the spout upper tube 28 may be enlarged to reduce the gap 294' between the outer surface 261 of the upwardly extending connector tube 248 and the inner surface 236 of the spout upper tube 28. The reduced gap 294' provides for an enhanced electrical connection, and more particularly for an enhanced lower capacitive coupling 216'.

Illustratively, the docking cradle 50' is supported for rotation with the spout upper tube 28 by horizontal swing arm 154. More particularly, collar 156 is threadably coupled to a cap 300 secured (e.g., brazed) to an upper end of the spout upper tube 28. The docking cradle 50 illustratively includes a c-shaped retainer 158' including opposing arms 160*a* and 160*b*. The retainer 158 is illustratively supported for rotation by a pivot coupling 302. A magnet 304 may be supported by the retainer 158' to provide a magnetic coupling with the spout nest 46'. More particularly, the spout nest 46' illustratively includes a magnetically attractive material (e.g., metal) that is attracted to the magnet 304 to releasably couple the spout nest 46' to the retainer 158'.

The spout nest 46' illustratively includes upper and lower flanges 306 and 308 defining an annular groove 310 configured to receive the arms 160*a* and 160*b* of the retainer 158'. A magnetic coupling similar to the magnetic coupling 140 as detailed above is configured to releasably couple the sprayhead 44 to the spring spout 62 through the spout nest 46'.

Although the invention has been described in detailed with reference to certain preferred embodiments, variations of modifications exist within the spirit and scope of the invention as described and defined in the following claims.

The invention claimed is:

1. A faucet comprising:

a spout base;

a spring spout including a helical spring having opposing first and second ends, the first end coupled to the spout base;

a flexible tube supported for sliding movement within the spout base and the spring spout;

a spout nest coupled to the second end of the spring spout;

a sprayhead fluidly coupled to the flexible tube and releasably coupled to the spout nest;

a docking cradle supported by the spout base and configured to releasably couple to the spout nest;

a support arm having a first end operably coupled to the spout base separate from the first end of the spring spout, and a second end supporting the docking cradle for movement independent of the spring spout; and wherein the spout nest comprises:

an upper flange;

a lower flange; and an annular groove defined between the upper flange and the lower flange, the annular groove configured to receive the docking cradle.

2. The faucet of claim 1, further comprising a magnetic coupling releasably coupling the sprayhead to the spout nest.

3. The faucet of claim 2, further comprising a magnet and a wand retainer to secure the magnet to the spout nest, and a magnetically attractive member secured to the sprayhead.

4. The faucet of claim 1, wherein the docking cradle includes a c-shaped retainer configured to engage the spout nest.

5. The faucet of claim 1, wherein the docking cradle includes a magnet configured to releasably couple to the spout nest.

6. The faucet of claim 1, wherein the first end of the support arm is supported for rotation about a longitudinal axis of the spout base.

7. The faucet of claim 1, wherein a first mode of operation is defined when the spout nest is coupled to the docking cradle and the sprayhead is coupled to the spout nest, a second mode of operation is defined when the spout nest is removed from the docking cradle and the sprayhead is coupled to the spout nest, and a third mode of operation is defined when the spout nest is coupled to the docking cradle and the sprayhead is removed from the spout nest.

8. The faucet of claim 7, wherein a fourth mode of operation is defined when the spout nest is removed from the docking cradle and the sprayhead is removed from the spout nest.

9. The faucet of claim 1, further comprising:

a capacitive coupling between the spout base and the spring spout;

a capacitive sensor operably coupled with the spring spout through the capacitive coupling;

a controller operably coupled with the capacitive sensor; and an actuator driven valve fluidly coupled to the flexible tube and controlled by the controller.

10. A faucet comprising:

a spout lower hub;

a spout upper tube supported by the spout lower hub;

a first pivot coupling between the spout lower hub and the spout upper tube, the first pivot coupling providing for rotation between the spout upper tube and the spout lower hub;

a first capacitive coupling between the spout lower hub and the spout upper tube;

an upper delivery spout supported by the spout upper tube;

a second pivot coupling between the spout upper tube and the upper delivery spout, the second pivot coupling providing for rotation between the upper delivery spout and the spout upper tube;

a second capacitive coupling between the spout upper tube and the upper delivery spout; and a capacitive sensor operably coupled with the upper delivery spout through the second capacitive coupling and the first capacitive coupling.

11. The faucet of claim 10, wherein:

the spout lower hub includes an upwardly extending connector tube;

the first pivot coupling includes a lower retaining sleeve received radially intermediate the upwardly extending tube of the spout lower hub and the spout upper tube; and the first capacitive coupling includes a metal bushing received radially intermediate the upwardly extending tube of the spout lower hub and the spout upper tube, and axially spaced relative to the lower retaining sleeve, and a retaining washer secured to the upwardly extending connector tube of the spout lower hub and configured to axially retain the metal bushing on the upwardly extending connector tube of the spout lower hub.

12. The faucet of claim 10, wherein:

the upper delivery spout includes a downwardly extending connector tube;

the second pivot coupling includes an upper retaining sleeve received radially intermediate the spout upper tube and the downwardly extending connector tube of the upper delivery spout; and the second capacitive coupling includes a metal contact supported by the upper retaining sleeve, the metal contact including an outer portion in electrical communication with the spout upper tube and an inner portion in electrical communication with the downwardly extending connector tube of the upper delivery spout.

13. The faucet of claim 12, wherein the metal contact of the second capacitive coupling comprises a contact spring including a plurality of coils extending between opposing first and second ends, the coils including an outwardly facing surface contacting the spout upper tube, and an inwardly facing surface contacting the downwardly extending connector tube of the upper delivery spout.

14. The faucet of claim 13, wherein:

the upper retaining sleeve includes a side wall, and opposing lower and upper posts formed within the side wall; and the spring extends in an axial direction with the first end received over a lower post of the upper retaining sleeve, and the second end received over the upper post of the upper retaining sleeve.

15. The faucet of claim 10, wherein the upper delivery spout comprises:

a spring spout including a helical spring having opposing first and second ends;

a downwardly extending connector tube operably coupled to the first end of the spring spout; and a flexible tube supported for sliding movement within the downwardly extending connector tube and the spring spout.

16. The faucet of claim 15, further comprising:

a spout nest coupled to the second end of the spring spout;

a sprayhead fluidly coupled to the flexible tube and releasably coupled to the spout nest;

a support arm having a first end and a second end, the first end coupled to the spout upper tube; and a docking cradle coupled to the second end of the support arm and configured to releasably couple to the spout nest.

17. The faucet of claim 16, wherein a first mode of operation is defined when the spout nest is coupled to the docking cradle and the sprayhead is coupled to the spout nest, a second mode of operation is defined when the spout nest is removed from the docking cradle and the sprayhead is coupled to the spout nest, and a third mode of operation is defined when the spout nest is coupled to the docking cradle and the sprayhead is removed from the spout nest.

18. The faucet of claim 17, wherein a fourth mode of operation is defined when the spout nest is removed from the docking cradle and the sprayhead is removed from the spout nest.

19. The faucet of claim 10, further comprising:

a controller operably coupled with the capacitive sensor; and an actuator driven valve fluidly coupled to the upper delivery spout and controlled by the controller.

20. The faucet of claim 19, further comprising a manual valve fluidly coupled in series with the actuator driven valve.

21. A faucet comprising:

a spout base;

a spring spout including a helical spring having opposing first and second ends, the first end coupled to the spout base;

a flexible tube supported for sliding movement within the spout base and the spring spout;

a spout nest coupled to the second end of the spring spout;

a sprayhead fluidly coupled to the flexible tube and releasably coupled to the spout nest;

a docking cradle supported by the spout base and configured to releasably couple to the spout nest;

a support arm having a first end operably coupled to the spout base separate from the first end of the spring spout, and a second end supporting the docking cradle for movement independent of the spring spout; and wherein the spout base comprises:

a spout upper tube;

a retaining sleeve supported within the spout upper tube; and a connector tube coupled to the spring spout, the connector tube rotatably supported by the retaining sleeve.

22. The faucet of claim 21, wherein the spout base further comprises a cap supported by the spout upper tube and disposed outwardly of the spout upper tube and the retaining sleeve, the cap rotatably supporting the support arm.

23. The faucet of claim 21, further comprising a contact spring including a plurality of coils extending between opposing first and second ends, the coils including an outwardly facing surface contacting the spout upper tube, and an inwardly facing surface contacting the connector tube.

* * * * *